US005357274A

United States Patent [19]

Kitamura

[11] Patent Number: 5,357,274

[45] Date of Patent: Oct. 18, 1994

[54] IMAGE RECORDING APPARATUS WITH A VIBRATING PARTICLE CONTROLLER

[75] Inventor: Tetsuya Kitamura, No. 1-13-4, Fukumitsunishi, Gifu-shi, Gifu-Ken, Japan

[73] Assignee: Brother Kogyo Kabushiki Kaisha, Aichi, Japan

[21] Appl. No.: 994,317

[22] Filed: Dec. 21, 1992

[30] Foreign Application Priority Data

Dec. 20, 1991 [JP] Japan ..... 3-338553
Jan. 29, 1992 [JP] Japan ..... 4-14061

[51] Int. Cl.[5] ..... B41J 2/415
[52] U.S. Cl. ..... 347/55; 346/159
[58] Field of Search ..... 346/140 R, 159; B41J 2/415

[56] References Cited

U.S. PATENT DOCUMENTS 3,689,935 9/1972 Pressman et al. ..... 346/159
5,202,704 4/1993 Iwao ..... 346/140 R

*Primary Examiner*—Benjamin R. Fuller
*Assistant Examiner*—Alrick Bobb
*Attorney, Agent, or Firm*—Oliff & Berridge

[57] ABSTRACT

In an image recording apparatus for recording an image on an image recording medium, a particle controller having at least one aperture receives electrically charged particles and selectively allows the electrically charged particles to pass through the aperture. A back electrode is positioned to confront the particle controller, with a space being formed between the back electrode and the particle controller for enabling passage of an image recording medium. The back electrode electrostatically attracts the electrically charged particles having passed through the aperture of the particle controller in a direction toward the back electrode so that the electrically charged particles may be attached to the image recording medium positioned in the space. The particle controller is vibrated with a vibration acceleration having a value equal to or larger than 500 G.

26 Claims, 13 Drawing Sheets

VIBRATION RANGE
A
0
U
(UPPERMOST POSITION)
t
L
VIBRATION WAVEFORM
(LOWERMOST POSITION)
4
3
TONER
1
2
PARTICLE CONTROLLER
TONER
THICKNESS OF THE PARTICLE CONTROLLER

IMAGE RECORDING APPARATUS WITH A VIBRATING PARTICLE CONTROLLER

BACKGROUND OF THE INVENTION

1. Field of the Invention

The present invention relates to an image recording apparatus used for image copying and printing operation. More particularly the present invention relates to an image recording apparatus of a type employed with a particle controller having apertures for controlling flow of toner particles passing through the apertures to record a toner image on an image recording medium.

2. Description of Related Art

U.S. Pat. No. 3,689,935 has proposed an image recording apparatus of a type that has a source of electrically-charged coloring particles such as toner particles, a control electrode (which will be referred to as "a particle controller," hereinafter) having apertures for selectively allowing the toner particles to pass therethrough, and a back electrode roller. The particle controller includes a reference electrode, an insulative layer formed on the reference electrode, and a plurality of segmented control electrodes formed on the insulative layer. A plurality of apertures are formed in the particle controller so as to penetrate through the reference electrode, the insulative layer, and the segmented control electrodes at overlapping areas of the segmented control electrodes and the reference electrode. When the source of the electrically-charged toner particles supplies the electrically-charged toner particles to the reference electrode of the particle controller, the particle controller selectively allows the toner particles to pass through the apertures. The back electrode roller is electrically charged to have a polarity opposite to that of the electrically-charged toner particles. The toner particles which have passed through the apertures of the particle controller are therefore electrostatically attracted toward the back electrode roller. In other words, the toner particles that are modulated by the particle controller are attracted by and flow in the direction of the static electrical force produced by the back electrode roller. The toner particles then adhere to the image recording medium which passes between the particle controller and the back electrode roller, thus forming a toner image thereon.

When an image is recorded using the above image recording apparatus, however, a problem occurs in that toner particles clog the apertures of the particle controller.

A co-pending U.S. patent application U.S. Ser. No. 680,728 abandoned, has proposed one method for overcoming this problem in which an oscillating member is attached to the particle controller for vibrating the particle controller to shake loose the toner particles attached to the inner surface of the apertures of the particle controller. The image recording apparatus of the co-pending application has successfully improved image clarity.

Another co-pending U.S. patent application U.S. Ser. No. 781,416, U.S. Pat. No. 5,202,704 issued Apr. 13, 1993 has proposed another method for overcoming the above-described problem in which the oscillating member is indirectly attached to the particle controller. More specifically, the particle controller is provided with an elastic member which is attached to the oscillating member. The oscillating member produces ultrasonic waves to be propagated through the elastic member to the particle controller, so that the toner particles are shaken off from the particle controller.

SUMMARY OF THE INVENTION

The present inventor has inspected the image recording apparatus of the type proposed by the U.S. Ser. No. 680,728, and has discovered that because the toner particles tend to adhere tenaciously to the particle controller with a great adhesive force, the particle controller has to be vibrated at a fairly large amplitude vibration to remove the toner particles from the particle controller. The present inventor has further discovered that when performing image recording while applying large amplitude vibration to remove the toner particles from the particle controller, the particle controller becomes unable to sufficiently modulate the toner particles and image recordings produced by the particle controller are completely black and incomprehensible. The reason for this is the amplitude of the vibration applied to the particle controller is too large so that almost all the toner particles electrostatically attracted to the back electrode roller passes through the apertures and adhere to the image recording medium.

The present inventor has further inspected the image recording apparatus of the type proposed by the U.S. Ser. No. 781,416, and has discovered that the following problem occurs in the apparatus. When performing image recording with the apparatus, propagation of ultrasonic waves varies greatly between the particle controller and the elastic member. Therefore, the vibration which the oscillating member generates in the elastic member is not transmitted effectively to the particle controller. Therefore, the particle controller may have areas where vibration is not uniform, i.e., where vibration nodes are generated. Such vibration nodes allow toner particles to clog up the apertures of the particle controller.

One object of the present invention is therefore to solve the above-described problems by using vibration applying means for vibrating the particle controller at the optimum vibration required to prevent the apertures from being clogged with the toner particles while allowing the particle controller to adequately modulate the toner particles.

Another object of the present invention is to solve the aforementioned problems by allowing stable vibration to be effectively transmitted from the elastic member to the particle controller, when the particle controller is attached with the oscillation member via the elastic member. The resulting stable vibration of the particle controller prevents the apertures of the particle controller from clogging with toner, thus producing sharp, high quality image recordings at a reasonable price.

The above and other objects of the present invention are solved by providing an image recording apparatus for recording an image on an image recording medium, comprising: supply means for supplying electrically charged particles; a particle controller having at least one aperture, the particle controller receiving the electrically charged particles from the supply means and selectively allowing the electrically charged particles to pass through the aperture; a back electrode positioned to confront the supply means through the particle controller, the back electrode being spaced from the particle controller by a space enabling passage of an image recording medium, the back electrode electrostatically attracting the electrically charged particles having passed through the aperture of the particle controller in a direction toward the back electrode so that the electrically charged particles may be attached to the image recording medium positioned in the space to thereby form an image of the electrically charged particles on the image recording medium; and vibration applying means for vibrating the particle controller with a vibration acceleration having a value equal to or larger than 500 G.

The vibration applying means preferably vibrates the particle controller, at least at an area around the aperture, with a vibration amplitude having a value smaller than half a thickness of the particle controller.

The vibration applying means preferably includes: a vibrating member attached to the particle controller on its side confronting to at least one of the supply means and said back electrode, the vibrating member having at least one opening for exposing the at least one aperture of the particle controller to the at least one of the supply means and said back electrode, the opening having a width in its widthwise direction; and an oscillating member for producing in the vibrating member a first vibration wave having a first wavelength, the vibrating member allowing a first part of said particle controller contacted with the vibrating member to follow the first vibration produced in the vibrating member, the first wavelength having a value larger than the width of the opening of the vibrating member.

The vibrating member of the vibration applying means produces a second vibration wave having a second wavelength in a second part of the particle controller positioned corresponding to the opening of the vibrating member, the second wavelength having a value larger than the width of the opening of the vibrating member.

According to another aspect of the present invention, an image recording apparatus for recording an image on an image recording medium, comprises: supply means for supplying electrically charged particles; a particle controller having at least one aperture, the particle controller receiving the electrically charged particles from the supply means and selectively allowing the electrically charged particles to pass through the aperture; a back electrode positioned to confront the supply means through the particle controller, the back electrode being spaced from the particle controller by a space enabling passage of an image recording medium, the back electrode electrostatically attracting the electrically charged particles having passed through the aperture of the particle controller in a direction toward the back electrode so that the electrically charged particles may be attached to the image recording medium positioned in the space to thereby form an image of the electrically charged particles on the image recording medium; a vibrating member attached to the particle controller on its side confronting to at least one of the supply means and the back electrode, the vibrating member having at least one opening for exposing the at least one aperture of the particle controller to the at least one of the supply means and the back electrode, the opening having a width in its widthwise direction; and an oscillating member for producing in the vibrating member a first vibration wave having a first wavelength, the first wavelength having a value larger than the width of the opening of the vibrating member, wherein the vibrating member allows a first part of the particle controller contacted with the vibrating member to vibrate along with the vibrating member to be vibrated with the first vibration.

The vibrating member may allow a second part of said particle controller positioned corresponding to the opening of the vibrating member to vibrate with a second vibration wave having a second wavelength, the second wavelength having a value larger than the width of the opening of the vibrating member.

According to further aspect of the present invention, an image recording apparatus for recording an image on an image recording medium comprises: a particle controller having first and second sides and having at least one aperture penetrating through the particle controller from the first side to the second side, the particle controller selectively allowing electrically charged particles to pass through the aperture from the first side toward the second side; a back electrode positioned to confront the second side of the particle controller with a space being formed between the back electrode and the second side of the particle controller for enabling passage of an image recording medium, the back electrode electrostatically attracting, in a direction toward the back electrode, the electrically charged particles having passed through the aperture of the particle controller so that the electrically charged particles may be attached to the image recording medium positioned in the space to thereby form an image of the electrically charged particles on the image recording medium; and vibration applying means for vibrating the particle controller with a vibration acceleration of a value equal to or higher than 500 G.

The vibration applying means may include oscillating means for oscillating a vibration and transmitting the vibration to the particle controller, the vibration having a frequency and an amplitude which have such values as allow the particle controller to be vibrated with the vibration acceleration equal to or higher than 500 G.

The aperture is formed in the particle controller to extend in a direction from the first side to the second side, the particle controller having a thickness defined as a distance between the first and second sides along the aperture extending direction. The vibration applying means allows the particle controller to be shifted along the aperture extending direction in an oscillating manner so that the particle controller may be vibrated, at least at an area around the aperture of the particle controller, with a maximum shift amount having a value smaller than the thickness of the particle controller.

The vibration applying means includes oscillating means for oscillating a vibration and transmitting the vibration to the particle controller, the vibration having an amplitude which have such values as allows the particle controller to be vibrated with a vibration amplitude of a value smaller than a half the thickness of the particle controller, at least at an area around the aperture of the particle controller.

The vibration applying means may include a vibrating member attached to the particle controller and an oscillating member for oscillating a vibration in the vibrating member, the vibrating member allowing the particle controller to vibrate along with the vibrating member. The oscillating member oscillates the vibration which have such frequency and amplitude as allow the particle controller to be vibrated with the vibration acceleration having a value equal to or higher than 500 G and with the vibration amplitude having a value smaller than a half the thickness of the particle controller, at least at an area around the aperture of the particle controller.

The vibration applying means may include: a vibrating member attached to at least one of the first and second sides of the particle controller and having at least one opening which communicates with the at least one aperture of the particle controller and which has a width in its widthwise direction, the particle controller having a first part positioned corresponding to an area of the at least one of the first and second sides contacted with the vibrating member and a second part positioned corresponding to the opening of the vibrating member; and an oscillating member for producing an oscillation having a frequency to produce in the vibrating member a first vibration wave having a first wavelength corresponding to the frequency of the oscillation, the vibrating member allowing the particle controller to vibrate, at the first part thereof, along with the vibrating member so that the first vibration wave having the first wavelength may be produced in the particle controller at the first part.

The oscillating member of the vibration applying means produces the oscillation having such a frequency as allows the first wavelength to have a value larger than the width of the opening of the vibrating member.

In the case where the opening of the vibrating member has a circularly-shaped cross section, the oscillating member of the vibration applying means produces the oscillation having such a frequency as allows the first wavelength to have a value larger than the diameter of the circularly-shaped opening of the vibrating member. In the case where the opening of the vibrating member has a slit shape which extends in its longitudinal direction and has a width in its widthwise direction extending perpendicularly to the longitudinal direction, the oscillating member of the vibration applying means to produces the oscillation having such a frequency as allows the first wavelength to have a value larger than the width of the slit-shaped opening of the vibrating member. In the case where the opening of the vibrating member has a longitudinal direction and a widthwise direction extending perpendicularly to the longitudinal direction and has a maximum width in the widthwise direction, the oscillating member of the vibration applying means produces the oscillation having such a frequency as allows the first wavelength to have a value larger than the maximum width of the opening of the vibrating member.

The vibrating member may produce, in the particle controller at a second part thereof, a second vibration wave having a second wavelength which corresponds to the frequency of the oscillation. The oscillating member of the vibration applying means produces the oscillation having such a frequency as allows the second wavelength to have a value larger than the width of the opening of the vibrating member.

In the case where the opening of the vibrating member has a circularly-shaped cross section, the oscillating member of the vibration applying means produces the oscillation having such a frequency as allows the second wavelength to have a value larger than the diameter of the circularly-shaped opening of the vibrating member. In the case where the opening of the vibrating member has a slit shape which extends in its longitudinal direction and has a width in its widthwise direction extending perpendicularly to the longitudinal direction, the oscillating member of the vibration applying means to produces the oscillation having such a frequency as allows the second wavelength to have a value larger than the width of the slit-shaped opening of the vibrating member. In the case where the opening of the vibrating member has a longitudinal direction and a widthwise direction extending perpendicularly to the longitudinal direction and has a maximum width in the widthwise direction, the oscillating member of the vibration applying means produces the oscillation having such a frequency as allows the second wavelength to have a value larger than the maximum width of the opening of the vibrating member.

BRIEF DESCRIPTION OF THE DRAWINGS

The above and other objects, features and advantages of the present invention will become more apparent from reading the following description of the preferred embodiments taken in connection with the accompanying drawings in which:

FIG. 2(*b*) is a schematic plan view of the particle controller of FIG. 2(*a*);

FIGS. 4(*b*) and 4(*c*) show the positional relationship between a toner particle and the aperture vibrated in the waveform shown in FIG. 4(*a*);

DETAILED DESCRIPTION OF THE PREFERRED EMBODIMENTS

Referring now to the accompanying drawings, preferred embodiments of the invention will be described in detail, hereinafter.

A first preferred embodiment will be described below, with reference to FIGS. 1 through 4(*c*).

Figure 1:
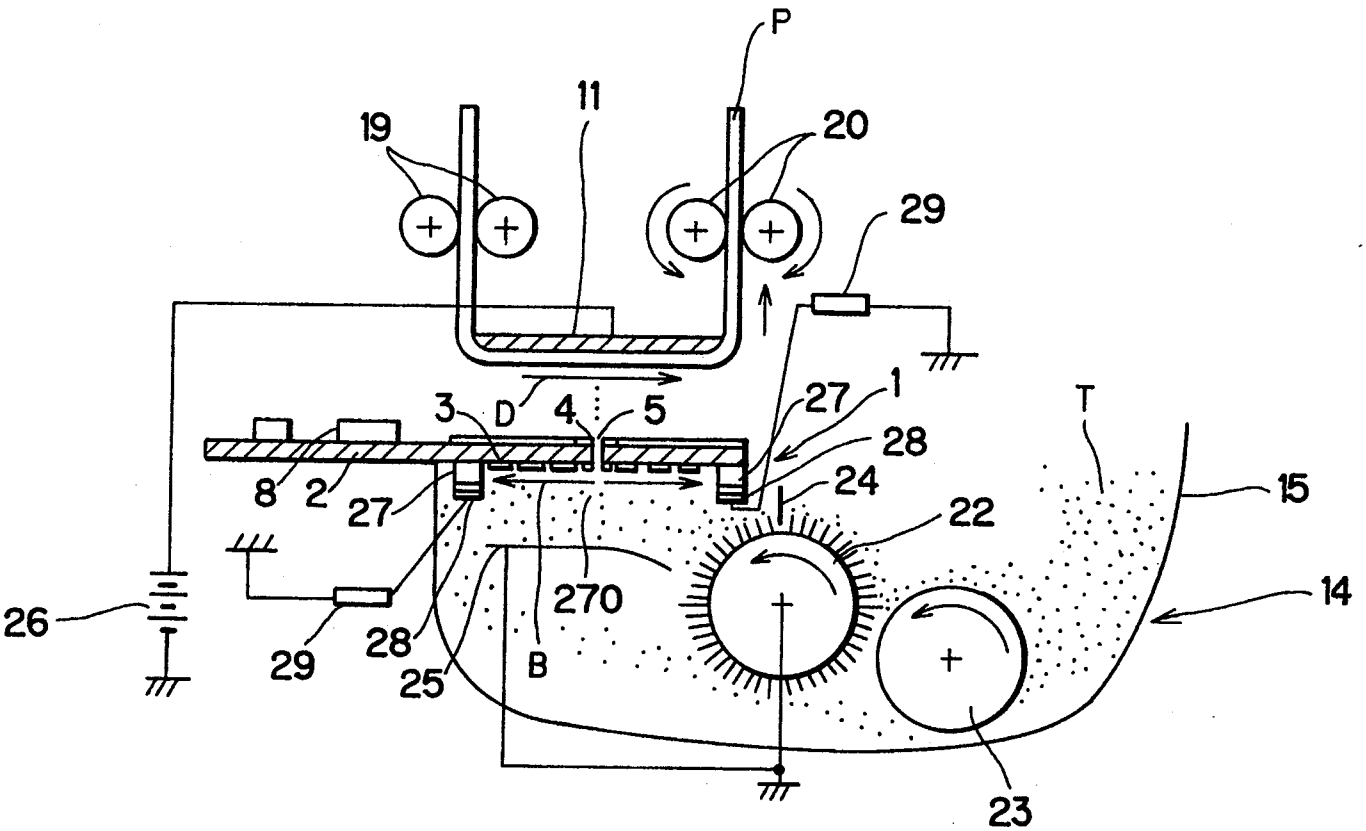
FIG. 1 briefly shows a construction of an image recording apparatus according to a first embodiment of the present invention.

FIG. 1 schematically shows a construction of the image recording apparatus of the first embodiment.

As shown in FIG. 1, the image recording apparatus of the present embodiment includes a toner supply device 14 for supplying electrically-charged toner particles, a particle controller 1 for modulating flow of the electrically-charged toner particles supplied from the toner supply device 14, and a back electrode 11 for electrostatically attracting thereto the toner particles modulated by the particle controller 1. The toner particles attracted to the back electrode 11 impinge and adhere to a surface of an image recording medium P which passes between the particle controller 1 and the back electrode 11.

The toner supply device 14 includes a brush roller 22, a rotatable toner supply roller 23, a scratch member 24 and a toner guide plate 25. The supply roller 23 is provided so as to contact the brush roller 22. The scratch member 24 is installed so that the bristles of the brush roller 22 scratch against the scratch member 24. The toner guide plate 25 is provided for guiding to the particle controller 1 the mist of toner particles which is generated when the toner particle covered bristles of the brush roller 22 scratch against the scratch member. The toner guide plate 25 is electrically grounded. The toner supply device 14 is encased by a toner case 15 in which toner particles T are stored.

Figure 2A:
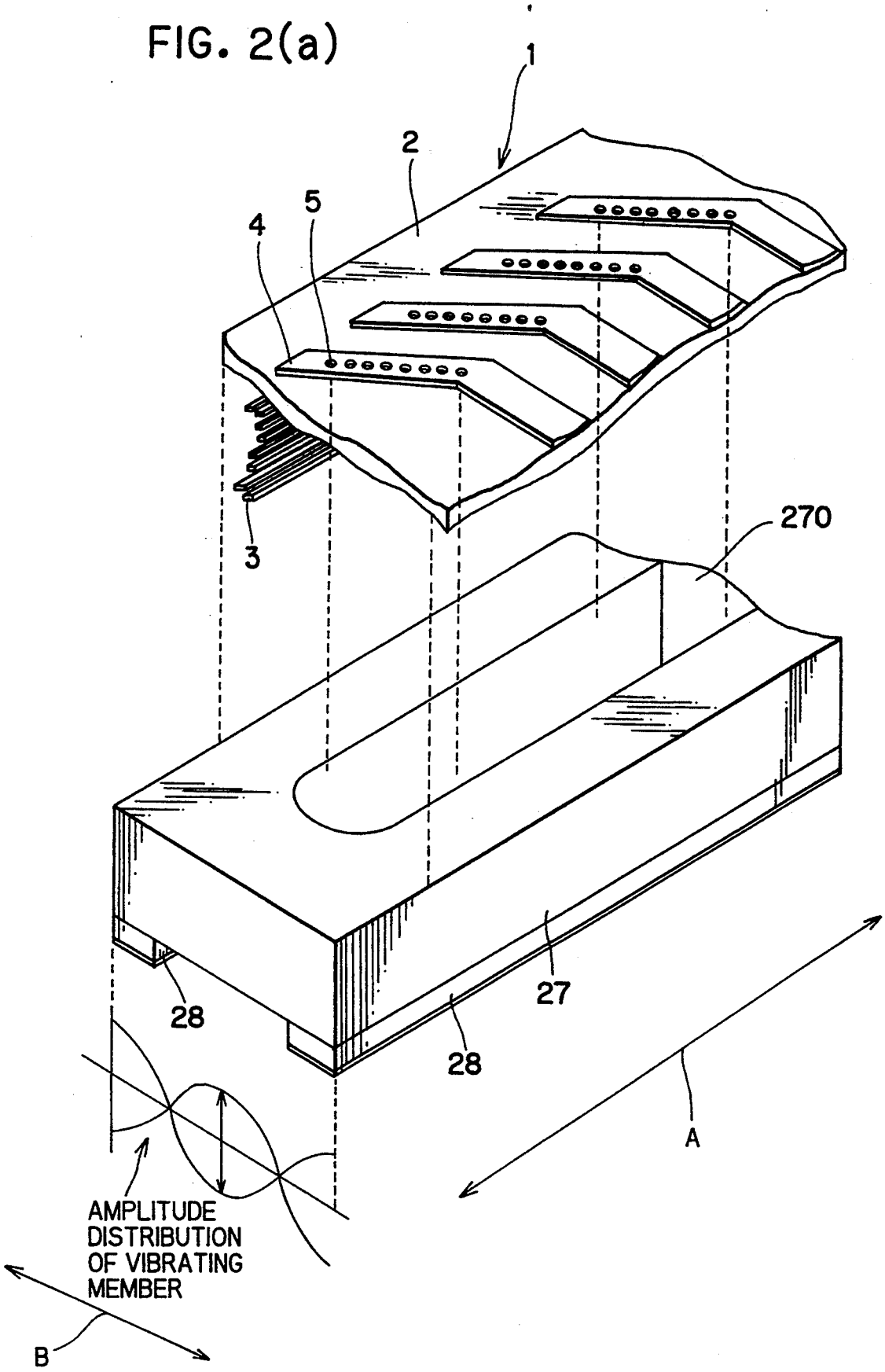
FIG. 2(*a*) is a schematic perspective view of the particle controller provided in the image recording apparatus of the first embodiment.
Figure 2B:
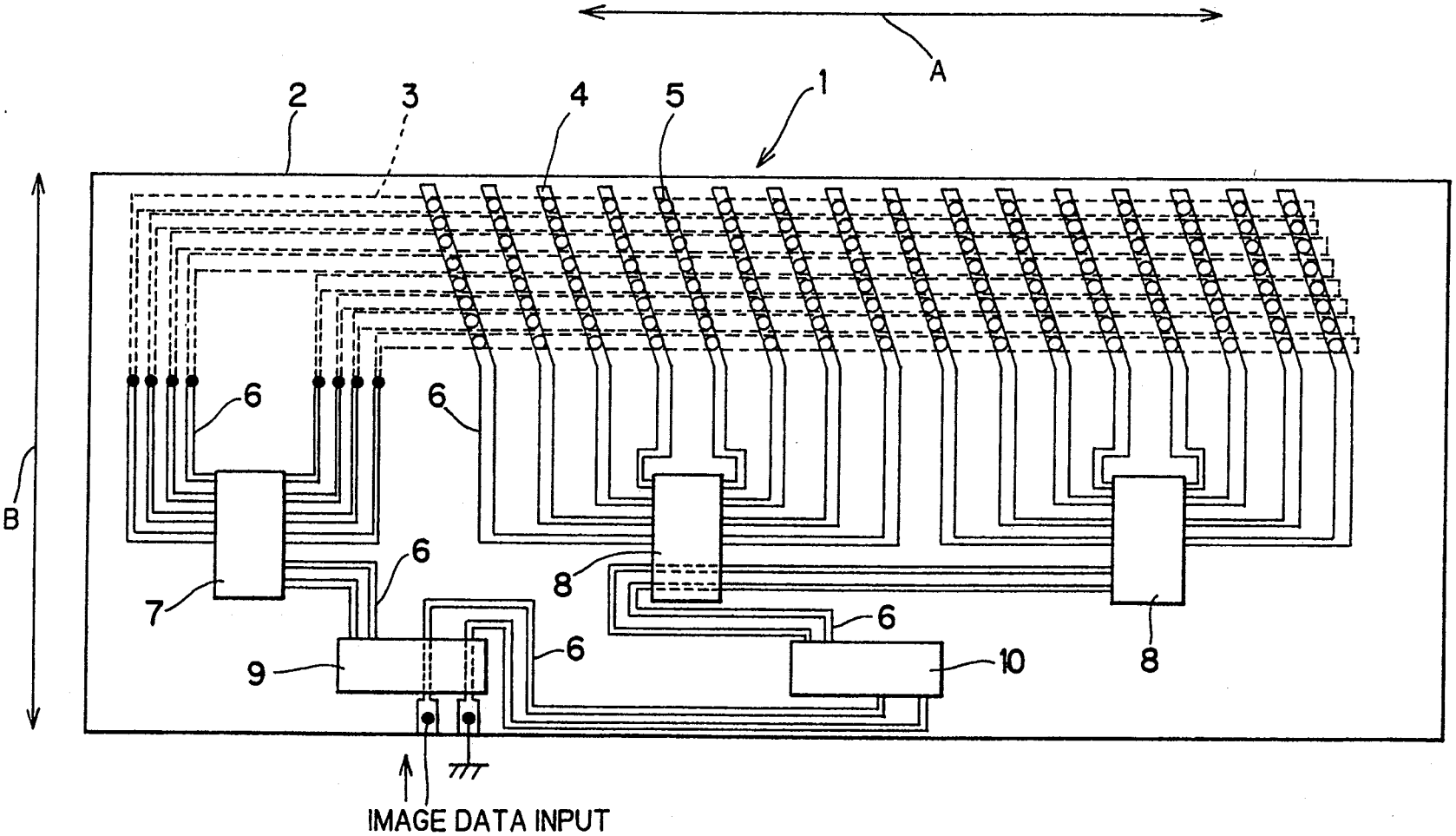

In the image recording apparatus shown in FIG. 1, the particle controller 1 is provided immediately above the toner guide plate 25. Illustratively, the particle controller 1 is positioned approximately 5 [mm] above the toner guide plate 25 of the toner supply device 14. As shown in FIG. 2(*a*), the particle controller 1 mainly includes an insulative plate 2 of a rectangular shape. In this example, the insulative plate 2 is formed of a resin film 2 such as a 25 μm (micron) thick polyimide film. As shown in FIG. 2(*b*), a plurality of (e.g. sixteen) data electrodes 4 are arranged on one surface of the rectangular-shaped insulative plate 2 along the lengthwise direction indicated in the drawing by an arrow A. Each of the data electrodes 4 extends partially across the insulative plate 2 in the widthwise direction indicated in the drawing by an arrow B. On the other surface of the insulative plate 2, a plurality of (e.g. eight) scan. electrodes 3 are arranged in the widthwise direction B of the insulative plate 2. Each of the plurality of scan electrodes 3 extends in the lengthwise direction A of the insulative plate 2. Accordingly, as apparent from FIG. 2(*b*), the plurality of data electrodes 4 and the plurality of scan electrodes 3 are arranged in a slanting criss-cross pattern, with the insulative plate 2 being sandwiched therebetween. As shown in FIG. 1, the particle controller 1 is installed in the image recording apparatus in such a manner that the scan electrodes 3 confront the toner supply device 14 and the data electrodes 4 confront the back electrode 11.

The particle controller 1 is formed with a plurality of apertures or through-holes 5 penetrating through the scan electrodes 3, the insulative plate 2 and the data electrodes 4. More specifically, the apertures 5 are formed through the particle controller 1 where the scan electrodes 3 intersect the data electrodes 4, so that the apertures 5 are arranged at a fixed same distance along the lengthwise direction A of the particle controller 1.

As shown in FIG. 2(*b*), the scan electrodes 3 are connected individually to a scan electrode drive element 7. The scan electrode drive element 7 is connected to a scan circuit 9. The scan circuit 9 serves to control the scan electrode drive element 7 to apply a 0 volt voltage to one scan electrode 3 while applying a negative 75 volt voltage to the others. An electric field is therefore formed between the toner guide plate 25 and those scan electrodes 3 that are applied with the negative 75 volt voltage. The data electrodes 4 are connected individually to a data electrode drive element 8. The data electrode drive element 8 is connected to an image data output circuit 10. The image data output circuit 10 controls the data electrode drive element 8 to switch voltage applied to each of the data electrodes 4 between 0 volt voltage and a negative 75 volt voltage, dependently on the image data supplied to the image data output circuit 10 from an image signal source provided in the image recording apparatus (not shown in the drawing).

It is noted that the scan electrodes 3, the data electrodes 4, the scan electrode drive element 7, the scan circuit 9, the data electrode drive element 8 and the image data output circuit 10 are all mounted on the surfaces of the particle controller 1. Electrode film 6 patterned to enable correct mounting of these elements to the surfaces of the particle controller 1 are attached to the surfaces of the particle controller 1.

As shown in FIGS. 1 and 2(*a*), the particle controller 1 is attached with a vibrating member or a spacer 27 at its surface on which the scan electrodes 3 are mounted. The vibrating member 27 is provided, at its both sides in its widthwise direction B, with a pair of piezo-electric elements 28 which are electrically connected to a pair of oscillators 29. Each of the oscillators 29 applies a vibrating electric field to the piezo-electric element 28 connected thereto. The vibrating member 27 is constructed so as to resonate with the vibration developed on the piezo-electric elements 28. More specifically, as schematically illustrated in FIG. 2(*a*), the vibrating member 27 resonates with the vibration produced on the piezo-electric elements 28 so that a standing wave is generated on the vibrating member 27. The vibrating member 27 is constructed with materials and to size and shape specifications that permit generation of standing waves with nodes only at positions where no aperture 5 is formed in the particle controller 1.

In this example, the vibrating member 27 is designed to resonate at a frequency of 40 kHz. The oscillators 29 therefore apply to the piezo-electric elements 28 vibration voltage having frequency of 40 kHz.

The particle controller 1 vibrates along with the vibrating member 27. Accordingly, the oscillators 29 apply to the piezo-electric elements 28 vibration voltage having voltage amplitude of a value suitable for exciting the particle controller 1 with an amplitude greater than 0.025 micron at positions around the apertures 5 thereof.

The vibrating member 27 attached to the particle controller has a slit-shaped opening or through-hole 270 for exposing all the apertures 5 of the particle controller 1 to the guide plate 25.

As shown in FIG. 1, the back electrode 11 is positioned to confront the data electrodes 4 on the particle controller 1. The back electrode 11 is connected to a positive 600 volt voltage direct current power source 26.

In the image recording apparatus, a first pair of feed rollers 19 and a second pair of feed rollers 20 are installed for transferring the image recording medium P in a space between the back electrode 11 and the particle controller 1 in a direction indicated by an arrow D in FIG. 1. The particle controller 1 is positioned in the image recording apparatus so that the widthwise direction B of the particle controller 1 extends parallel to the image recording medium transferring direction D. Accordingly, the scan electrodes 3 mounted on the particle controller 1 extending in the lengthwise direction A extend perpendicularly to the image recording medium transferring direction D.

The image signal source (not shown in the drawing) in the image recording apparatus supplies image data to the particle controller 1. The scan circuit 9 controls the scan electrode drive element 7 so that the scan electrode drive element applies 0 volt voltage to the scan electrodes 3 one by one in response to the image data to thereby activate the scan electrodes one by one, so that the scan electrodes 3 perform a scanning operation. The image data output circuit 10 controls the data electrode driving element 8 in response to the image data to selectively apply 0 volt voltage and negative 75 volt voltage to the data electrodes 4. The image signal source further supplies transferring command signals to the second feed rollers 20. The second feed rollers 20 are driven to rotate in response to the transferring command signals so as to transfer the image recording medium P by one dot pitch distance, synchronously with the scanning operation of the scan electrodes 3. Accordingly, the scan electrodes 3, the data electrodes 4 and the second feed rollers 20 cooperate to record a desired toner image on the image recording medium P corresponding to the image data.

The image recording apparatus of the present embodiment having the above-described structure is operated, as will be described below.

In the toner supply device 14, the supply roller 23 rotates to carry the toner particles T on its peripheral surface. As the supply roller 23 rotates, it conveys the toner particles toward the brush roller 22. The toner particles T are triboelectrically charged when they contact the supply roller 23 and the brush roller 22. In this example, the toner particles T are charged to a negative polarity.

The toner particles T supplied to the brush roller 22 cling to the bristles of the brush roller 22. The brush roller 22 rotates to carry the toner particles to the scratch member 24. Because the scratch member 24 is fixed to the position where it comes in contact with the bristles of the brush roller 22, the bristles of the brush roller bend by their own elasticity when rotation of the brush roller 22 causes them to contact the scratch member 24. As the brush roller 22 further rotates, the bristles will snap away from the scratch member 24 by their own elasticity. This snapping action discharges the toner particles T clinging to the bristles of the brush roller 22 to form a mist of the toner particles T. The mist of toner particles T follows the toner guide plate 25 and moves in the direction toward the particle controller 1.

The mist of toner particles T is modulated by the one scan electrode 3 applied with 0 volt voltage and the others applied with negative 75 volt voltages. More specifically, the scan electrode 3 that is applied with the 0 volt voltage does not obstruct the flow of toner particles T, because no electric field is formed between this scan electrode 3 and the toner guide plate 25. On the other hand, flow of toner particles T to the scan electrodes 3 that are applied with the negative 75 volt voltage is blocked because between them and the toner guide plate 25 is formed an electric field which directs the negatively charged toner particles 16 back to the toner guide plate 25 and away from the negatively charged scan electrodes 3.

At the row of apertures 5 of the scan electrode 3 that is applied with 0 volt voltage, the negatively charged toner particles T are modulated by the voltage applied to the data electrodes 4 from the data electrode drive element 8. At the data electrode 4 that is applied with the 0 volt voltage, because no electric field is formed at the interior of the aperture 5, the toner particles T can pass through the aperture 5. On the other hand, at the data electrode 4 that is applied with the negative 75 volt voltage, because an electric field is formed at the interior of aperture 5, the negatively charged toner particles T are repelled and do not pass through the aperture 5. The negatively charged toner particles T that pass through the aperture 5 are then attracted along the electric field formed by the positive 600 volt voltage of the back electrode 11. The toner particles then attach to a surface of the image recording medium 13 passing between the particle controller 1 and the back electrode 11.

As described already, the scan circuit 9 activates the scan electrodes 3 one by one. The data electrode drive element 8 selectively applies to the data electrodes 4 either the 0 volt voltage or the negative 75 volt voltage dependently on the image data, to thereby apply to the apertures 5 positioned at the intersections between the activated scan electrode 3 and the data electrodes 4 with the corresponding 0 volt voltage or the negative 75 volt voltage. In this way, a desired toner image corresponding to the image data is recorded one line by one line on the image recording medium.

Once one scanning loop of the scan electrodes 3 has been completed, the feed rollers 20 are driven to rotate so that the image recording medium P is transferred by one dot pitch distance. Then, the above process is repeated. By the time the image recording medium P has been completely transported from between the particle controller 1 and the back electrode 11, a desired toner image will have been completely formed on the image recording medium P.

While the above-described image recording operation is progressing, the oscillators 29 supply the oscillating electric field to the piezo-electric elements 28 so as to oscillate the piezo-electric elements 28. The vibrating member 27 resonates with the vibration of the piezo-electric elements 28 to produce a standing wave. The particle controller 1 vibrates with the vibrating member 27 and develops the standing wave. The toner particles T that are supplied to the particle controller 1 but do not participate in the image recording process are shaken off the particle controller 1 by the vibration acceleration at which the particle controller 1 is vibrated. In this example, the areas around the apertures 5 of the particle controller 1 vibrate at frequency of 40 kHz and with amplitude of 0.1 microns. Accordingly, vibration acceleration obtained at the areas around the apertures 5 of the particle controller 1 can be determined as 645 G (gravitational acceleration) from the following formula (1):

$$V=\{A(2\pi f)^2\}/9.8 \quad (1)$$

where V is vibration acceleration [G (gravitational acceleration)], A is vibration amplitude [m], and f is vibration frequency [Hz] where 1 [G]=9.8 [m/s$^2$].

The present inventor conducted an experiment for showing the relationship between vibration acceleration V obtained at areas around the apertures 5 of the vibrating particle controller 1 and image recording performance of the vibrating particle controller 1. In the experiment, the above-described image recording operation was conducted repeatedly with varying vibration amplitude A and fixed vibration frequency f of the vibration applied to the particle controller 1. The vibration amplitude A was changed by changing the voltage of the vibrating electric field from the oscillators 29 to the piezo-electric elements 28. The image recording performance of the vibrating particle controller 1 at each vibration amplitude A was subjectively determined, as good or poor by observing images recorded at each vibration amplitude A.

In the experiment, negatively charged styrene acrylic pulverized toner particles, with average particle diameter of approximately 11 microns, were used as the toner particles T. The values of the vibration amplitude A and the vibration frequency f of the particle controller 1 were determined as detected by a "Photonic Sensor KD-100" (produced by Mechanical Technology Incorporated) and through subjecting the detected results to Fourier transformation.

Figure 3:
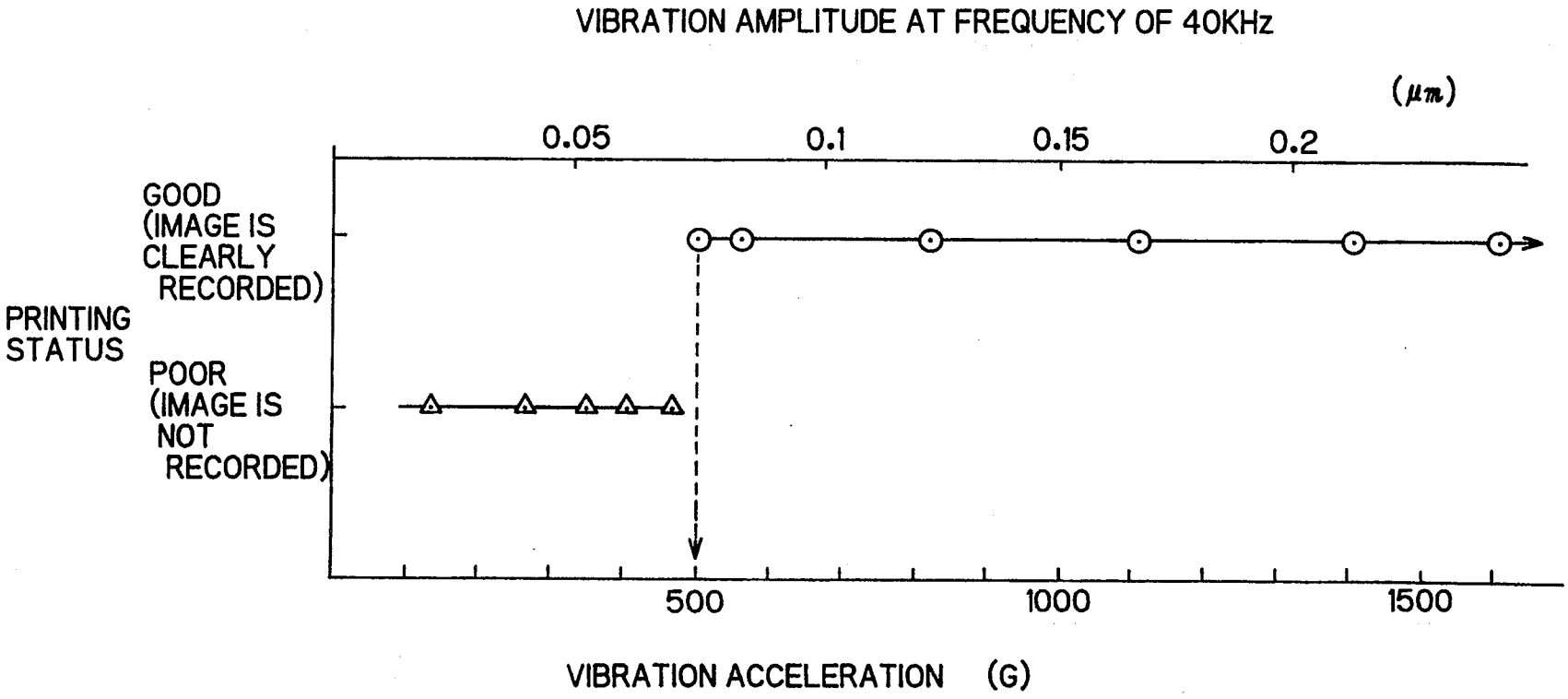
FIG. 3 graphically represents vibration amplitude and vibration acceleration of the vibration at which the particle controller of the first embodiment is vibrated and the print output status.

FIG. 3 shows the image recording performance in accordance with vibration amplitude A. Because the vibration frequency f was fixed, vibration acceleration V obtained on the particle controller 1 was proportional to the vibration amplitude A, as apparent from the formula (1). Therefore, the values of the vibration acceleration V corresponding to the values of the vibration amplitude A are also indicated in FIG. 3. Accordingly, FIG. 3 shows how the image recording performance was changed in accordance with the vibration acceleration V obtained on the particle controller. This test result shows that a minimum acceleration vibration of 500 G is necessary to prevent the apertures 5 of the particle controller 1 from clogging with the toner particles T.

According to the present invention, as apparent from the above, by generating at the particle controller 1 vibration acceleration V equal to or greater than 500 G, clogging of the apertures 5 of the particle control member 1 can be prevented, thus allowing proper modulation of the toner particles T by the particle controller 1.

Figures 4A, 4B, 4C:
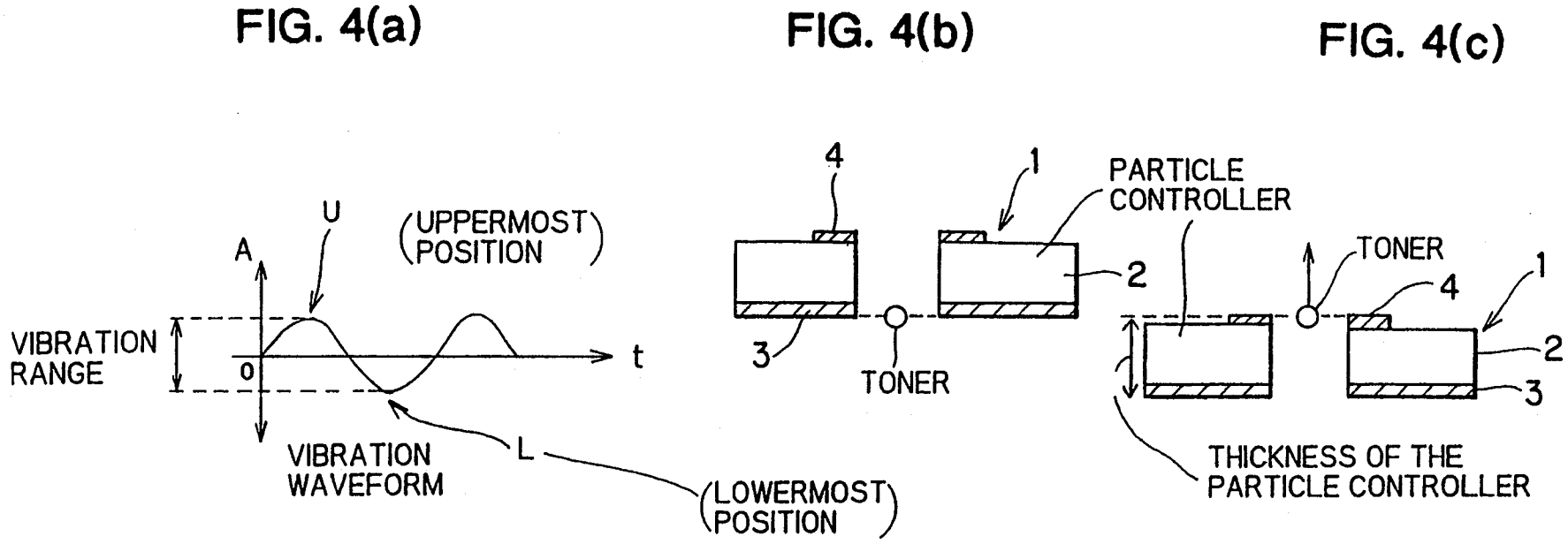
FIG. 4(*a*) schematically shows the waveform of the vibration developed near an aperture of the particle controller.

According to the present invention, to more effectively prevent toner particles T from clogging the apertures 5, the vibration range (i.e., the value of two times the length of the vibration amplitude A) of vibration applied to areas around the apertures 5 of the vibrating particle controller 1 should be smaller than the thickness of the particle controller. FIG. 4(*a*) schematically shows the waveform of vibration developed around an aperture 5 on the particle controller 1, and FIGS. 4(*b*) and 4(*c*) show the positional relationship between the toner particle T and the aperture 5. More specifically, FIG. 4(*b*) shows the positional relationship between the toner particle T and the aperture 5 when the particle controller 1 is at its uppermost position V, and FIG. 4(*c*) shows the positional relationship between the toner particle T and the aperture 5 when the particle controller 1 is at its lowermost position L. As apparent from FIGS. 4(*a*) through 4(*c*), if the vibration range of the particle controller 1 is equal to or greater than the thickness of the particle controller 1, the toner particle T supplied to the scan electrode 3 when the aperture 5 is at its uppermost position U, as shown in FIG. 4(*b*), will automatically reach the data electrode 4 when the aperture 5 reaches its lowermost position L, as shown in FIG. 4(*c*). Accordingly, the toner particle T will pass through the aperture 5 irrespective of the voltage applied to the data electrode 4 and the scan electrode 3. According to the present invention, the particle controller 1 is vibrated, at the areas around the apertures 5, with vibration amplitude A having a value lower than half the thickness of the particle controller. Accordingly, the toner particles T do not clog the apertures 5 of the particle controller 1.

According to the present invention, the particle controller is vibrated so that its vibration acceleration is equal to or greater than 500 G and so that vibration amplitude at areas around the apertures 5 is less than half the thickness of the particle controller. Accordingly, clogging of the apertures 5 of the particle controller 1 can be effectively prevented, thus allowing vibration of the particle controller 1 optimum for attaining proper modulation of the toner particles T.

In the above-described example, to generate the vibration acceleration of over 500 G, the particle controller 1 is vibrated at a frequency of 40 kHz and with an amplitude of 0.1 microns. However, the amount of the vibration amplitude A is not limited to 0.1 microns but may be freely selected, as long as the amount of the vibration frequency f is properly adjusted. For example, vibration having a vibration frequency of 80 kHz (which is twice the 40 kHz vibration frequency) and a vibration amplitude of 0.025 micron (which is one quarter of the 0.1 micron vibration amplitude) may be developed on the particle controller, which will attain the same vibration acceleration. Similarly, vibration having a vibration frequency of 20 kHz (which is half the 40 kHz vibration frequency) and a vibration amplitude of 0.4 micron (which is four times the 0.1 micron vibration amplitude) may be developed on the particle controller, which will also attain the same vibration acceleration.

It is noted that in the above description, the particle controller 1 is attached to the vibrating member 27 which is provided with the piezo-electric elements 28. However, the vibrating member 27 may be omitted, and the piezo-electric elements 28 directly attached to the particle controller 1. Also in such a case, vibration attaining a vibration acceleration of equal to or larger than 500 G should be produced on the particle controller. The particle controller should also be vibrated so that its vibration amplitude at areas around the apertures has a value lower than half the thickness of the particle controller.

In the above description, the particle controller is combined with the pair of piezo-electric elements 28 for producing the standing wave in the particle controller, as shown in FIG. 2(*a*). However, the pair of piezo-electric elements may be replaced with an exciting element and a vibration absorber as in a second embodiment of the present invention as will be described later. The exciting element and the vibration absorber are provided on both ends of the vibrating member in its lengthwise direction A and serve to produce a progressive wave to be propagated along the lengthwise direction A from the exciting element toward the vibration absorber. (Or otherwise, the exciting element and the vibration absorber may be provided on both sides of the vibrating member in its widthwise direction B and serve to produce a progressive wave to be propagated along the widthwise direction B from the exciting element toward the vibration absorber.) Also in such a case, a progressive wave attaining a vibration acceleration of equal to or larger than 500 G should be transmitted along the particle controller. Because the progressive wave propagated along the particle controller oscillates all the areas of the particle controller with the same vibration amplitude, the particle controller should vibrate, at all the areas including the areas around the apertures, with vibration amplitude having a value lower than half the thickness of the particle controller.

Referring now to FIGS. 5 through 12, a second preferred embodiment of the present invention will be described, hereinafter.

Figure 5:
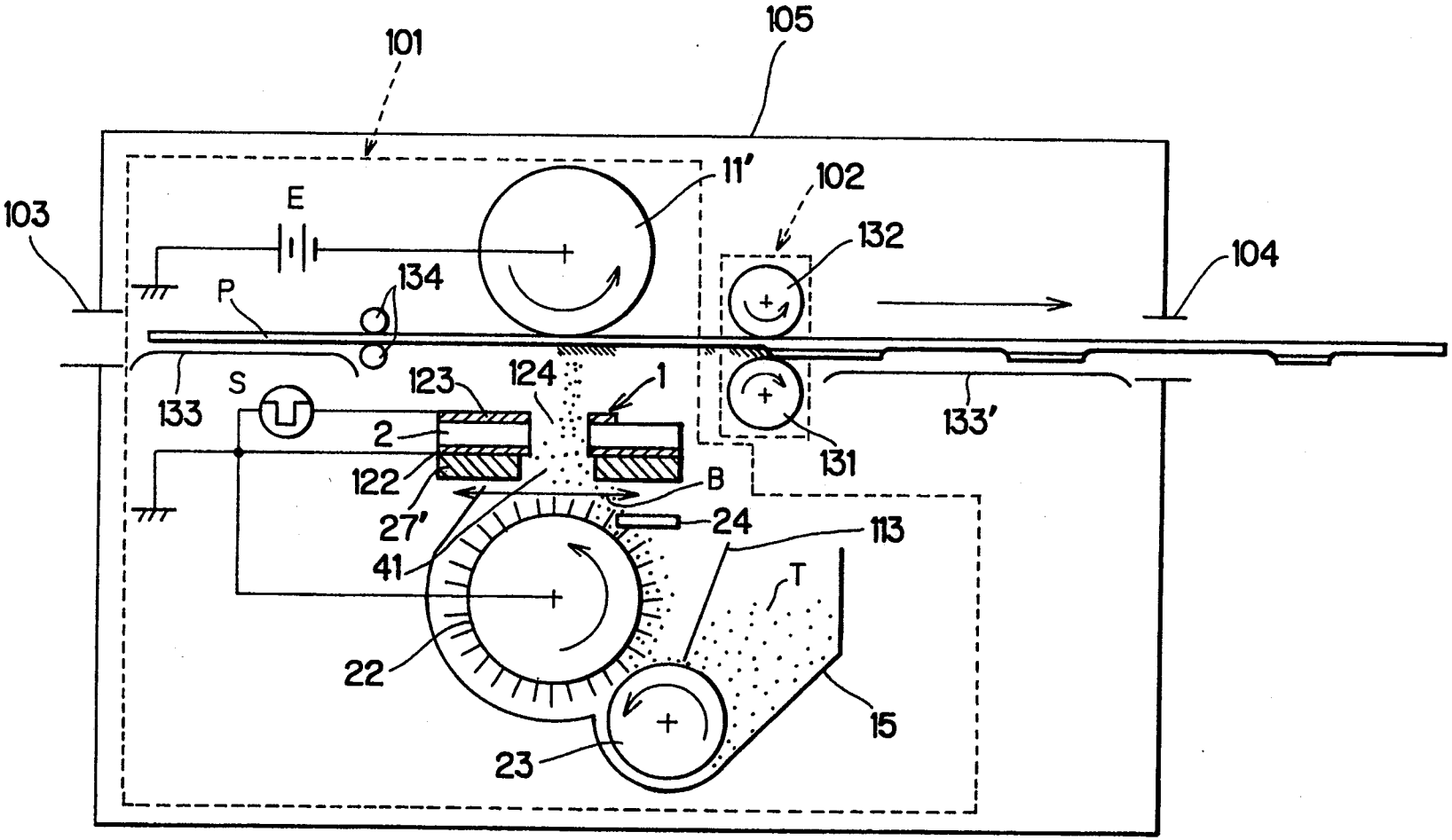
FIG. 5 briefly shows a mechanical construction of an image forming apparatus of the second embodiment of the present invention.

FIG. 5 briefly shows a mechanical construction of an image forming apparatus of the second embodiment.

The image forming apparatus has a housing 105 which is formed with a sheet inlet 103 on one side thereof and a sheet outlet 104 on the other side. Within the housing 105 of the image forming apparatus, an image recording portion 101 and a thermal fixing portion 102 are provided next to each other. The image recording portion 101 serves to record a desired toner image on a surface of an image recording medium P which has been inserted into the image recording portion 101 through the sheet inlet 103. The image recording portion 101 therefore corresponds to the image recording apparatus of the first embodiment. The thermal fixing portion 102 receives the image recording medium P which has been formed with the toner image in the image recording portion 101 and which has been transported thereto. The image fixing portion 102 thermally fixes the toner image to the surface of the image recording medium P according to well-known techniques.

In the image recording portion 101, a first guide 133 and a pair of feed rollers 134 are provided for transporting the image recording medium P from the sheet inlet 103 to the back electrode roller 11' and from the back electrode roller 11' to the thermal fixing portion 102. Within the housing 105, a second guide 133' is further provided for transporting the image recording medium P which has been subjected to the image fixing operation in the image fixing portion 102 toward the sheet outlet 104 to be exited therethrough.

In the image recording portion 101, similarly as in the image recording apparatus of the first embodiment, there are provided the toner case 15, the particle controller 1 and the back electrode 11' with a roller shape.

As in the first embodiment, the toner case 15 encases the supply roller 23, the brush roller 22, the scratch member 24 and stores therein the coloring material particles such as toner particles T. The toner case 15 further encases a toner layer thickness restriction member 113 for reducing to a uniform layer the layer of the toner particles T clinging to a peripheral surface of the supply roller 23.

Figure 6:
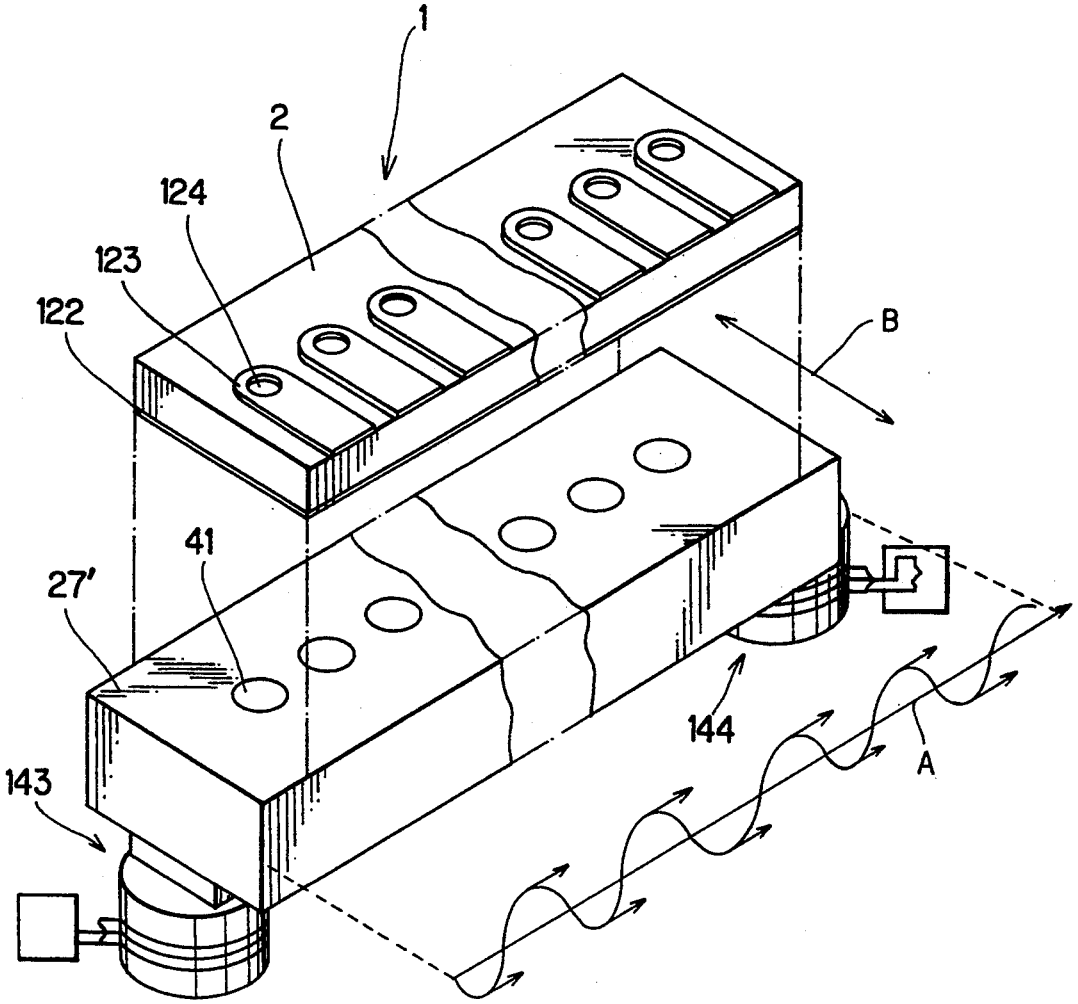
FIG. 6 is a perspective diagram of a particle controller of the second embodiment attached with the vibrating member, in which the particle controller is separated from the vibrating member for clearly showing the structure of the vibrating member.

The particle controller 1 of the present embodiment will be described in greater detail, hereinafter. As in the first embodiment, the particle controller is positioned above the brush roller 22. As shown in FIG. 6, the particle controller 1 includes an insulative layer 2 sandwiched between a single reference electrode 122 and a plurality of segmented control electrodes 123, all of through which penetrate a plurality of apertures or through-holes 124. The reference electrode 122 is attached to the surface of the insulative layer 2 that faces the brush roller 22. The segmented control electrodes 123 are attached to the surface of the insulative layer 2 confronting to the back electrode roller 11'. The segmented control electrodes 123 surround the apertures 124, respectively. As shown in FIG. 5, the reference electrode 122 is electrically grounded, and the segmented control electrodes 123 are electrically connected to an image signal source S provided within the image recording portion 101.

The insulative layer 2 is formed, for example, from a 25 μm (micrometers) thick macromolecular resin film such as a polyimide film. The reference electrode 122 and the segmented control electrodes 123 are formed from 1 micron thick layer films of metal such as copper produced through well-known sputtering techniques or Other film-forming methods. Each of the apertures 124 has a diameter approximately of 80 microns.

As shown in FIG. 6, the particle controller 1 is attached to the vibrating member 27' formed of elastic material. The vibrating member 27' is provided with a plurality of openings or through-holes 41. The number of openings 41 is equal to the number of the apertures 124 provided in the particle controller 1. The vibrating member 27 is attached to the reference electrode 122 of the particle controller 1 so that the plurality of openings 41 are aligned with the plurality of apertures 124. The openings 41 thus communicated with the apertures 124 expose the apertures 124 to the brush roller 22 so that the toner particles T from the brush roller 22 can freely pass through the openings 41 to the apertures 124.

The vibrating member 27' is formed of elastic metal such as aluminum or stainless steel and has a rectangular shape. For reasons which will be explained later, the openings 41 of the vibrating member 27' should have total area much smaller than the contacting surface area of the vibrating member 27' and the particle controller 1. In this example, each of the openings 41 has a circular-shape having a diameter equal to or less than 1 mm and therefore total area of the openings is sufficiently small in comparison with the contacting surface area of the vibrating member 27' and the particle controller 1. The vibrating member 27' should also have a thickness much larger than the thickness of the particle controller 1. In this example, the vibrating member 27' is formed from a 1 mm thick aluminum plate.

An oscillating element 143 is mounted on the vibrating member 27' at one end in its lengthwise direction indicated by an arrow A in FIG. 6. A vibration absorber 144 is mounted on the vibrating member 27' at its other end in the lengthwise direction A. The oscillating element 143 serves to produce a progressive wave to be transmitted along the vibrating member 27' in the lengthwise direction A from the one end toward the other end. The vibration absorber 144 serves to absorb the progressive wave thus transmitted. Illustratively, the exciting element 143 includes a Langevin oscillator equipped with a piezo-electric element sandwiched between a pair of electrodes. The piezo-electric element of the Langevin oscillator has applied thereto a vibrating voltage. The vibrating voltage causes the piezoelectric element to oscillate which in turn vibrates the vibrating member 27'. The vibration absorber 144 includes the Langevin oscillator combined with a resistor. In other words, in the vibrating absorber 144, the resistor is connected to the piezoelectric-element employed in the Langevin oscillator for consuming electromotive force generated due to vibration distortion.

As shown in FIG. 5, the back electrode roller 11' is positioned above the particle controller 1 so that the back electrode roller 11' confronts the segmented control electrodes 123. There is formed a space between the back electrode roller 11' and the particle controller 20 for allowing the image recording medium P to pass therethrough. The back electrode roller 11' is electrically connected to a power source E to be charged negatively, for example.

The thermal fixing portion 102 is provided with a heat roller 131 equipped with an internal heat source and a press roller 132 in such a manner that they are in contact with each other. The heat roller 131 and the press roller 132 thermally press the image recording medium P when it passes between the rollers 131 and 132.

The image forming apparatus of the present embodiment having the above-described structure operates, as will be described below.

In the image recording portion 101, similarly as in the image recording apparatus of the first embodiment, the supply roller 23 rotates to carry the toner particles T on its peripheral surface. As the supply roller 23 rotates, the thickness restriction member 113 reduces the toner particles carried on the peripheral surface of the supply roller 23 to a uniform layer. Thus formed uniform layer of the toner particles T are further carried on the supply roller 23 until contacted by the bristles of the brush roller 22. Then, the uniform layer of the toner particles T are transferred from the supply roller 23 onto the bristles of the brush roller 22. Accordingly, a fixed amount of toner particles T are always supplied to the brush roller 22. When the toner particles T contact the supply roller 23 and the bristles of the brush roller 22, the toner particles are triboelectrically charged. In this example, the toner particles T are charged to a positive polarity. As the brush roller 22 rotates, the bristles of the brush roller are brought into contact with the scratch member 24 so that the bristles are bent due to their own elasticity. As the brush roller further rotates, the bristles snap away from the scratch member 24, so that the toner particles held among the bristles fly up away from the bristles toward the particle controller 1. Thus, the brush roller 22 and the scratch member 24 supply a mist of the positively charged toner particles T to the particle controller 1.

The first guide 133 and the feed rollers 134 transport to the back electrode roller 11' the image recording medium P which has been inserted through the sheet inlet 3 into the image recording portion 101.

The image signal source S supplies image signal voltages to the segmented control electrodes 123 of the particle controller 1 for modulating the flow of the toner particles T in accordance with the image signal voltages. More specifically, the image signal source S selectively supplies a 0 volt voltage or a negative volt voltage to the segmented control electrodes 123. When an electrode 123 is supplied with a negative volt voltage, an electric field is generated in the interior of the aperture 124 positioned on the electrode 123. The electric field directs the positively charged toner particles T from the reference electrode 122 toward the segmented control electrode 123. The toner particles can therefore passes through the aperture 124. On the other hand, no electric field is generated in the interior of an aperture 124 positioned on the electrode 123 supplied with no voltage (0 volt voltage), and therefore the toner particles do not pass through the aperture 124.

In the present embodiment, similarly as in the first embodiment, the particle controller 1 vibrates with the vibrating member 27'. Toner particles T that are, or are about to become, attached to the particle controller 1 due to image forces and Van der Waals forces will be shaken off by the vibration acceleration obtained on the thus vibrated particle controller 1.

The vibration generated on the particle controller 1 will be described in greater detail, hereinafter. To the piezo-electric element of the exciting element 143 is applied a vibrating voltage which has such a frequency that resonates the vibrating member 27'. In this example, the piezo-electric element is supplied with the vibrating voltage with frequency of, for example, 40 kHz, that will cause resonance in the vibrating member 27'. Accordingly, a progressive wave having a frequency of 40 kHz (ultrasonic wave) is produced in the vibrating member 27' to be propagated therein along the lengthwise direction A. In this example, because the vibrating member 27' is formed from a 1 mm thick aluminum plate, the following formula (2) clearly shows that an ultrasonic wave having a wavelength of about 15 mm is propagated in the vibrating member.

The following formula (2) generally defines the wavelength of a transverse wave propagated along an elastic body formed of metal:

$$\lambda=\{\pi(h/f)3^{(1/2)}(E/\rho)^{(1/2)}\}^{(1/2)} \quad (2)$$

where

λ: wavelength h: thickness

=1 mm (for aluminum: vibrating member)

=0.025 mm (for polyimide: particle controller)

f: frequency=40,000 Hz

E: Young's Modulus

=7,000 kgf/mm$^2$ (for aluminum: vibrating member)

=380 kgf/mm$^2$ (for polyimide: particle controller)

ρ: density

=2.85 kgfs$^2$/mm$^4$ (for aluminum: vibrating member)

=1.39 kgfs$^2$/mm$^4$ (for polyimide: particle controller)

In this example, the wavelength of the progressive wave (15 mm) propagated along the vibrating member 27' (aluminum plate) is sufficiently large in comparison with the diameter of the circular-shaped openings 41 (1 mm). Accordingly, the progressive wave can develop almost uniform vibration even at the boundaries of the openings 41. In other words, the progressive wave is almost uniformly transmitted on the vibrating member 27' at all the areas including the boundaries of the openings 41. Accordingly, the progressive wave propagated on the vibrating member 27' is isolated from and unaffected by the existence of the openings 41. In other words, the vibrating member 27' is vibrated as if the vibrating member were formed with no opening 41.

As described already, the total area of the openings 41 is sufficiently small in comparison with the contacting surface area of the vibrating member 27' and the particle controller 1. Furthermore, all parts, except for the openings 41, of the vibrating member 27' have thickness of 1 mm which is sufficiently large in comparison with the thickness of the particle controller 1 (0.025 mm). Accordingly, the particle controller 1 can vibrate completely along with the vibrating member 27', except for areas positioned at the openings 41 of the vibration member 27'.

The insulative layer 2 formed of polyimide forms almost the entire portion of the particle controller 1 at areas positioned at the openings 41. The above formula (2) apparently shows that a progressive wave having the frequency of 40 kHz is propagated along a polyimide plate to have a wavelength of about 1.4 mm.

Accordingly, a progressive wave with its wavelength of about 1.4 mm is propagated at areas of the particle controller 1 positioned at openings 41. Because the 1 mm diameter of the opening 41, which defines the width of the area where the 1.4 mm wavelength wave is propagated, is smaller than the 1.4 mm wavelength, no nodes or other nonuniform waves are generated in the area.

To summarize, according to the present invention, the material of the vibrating member 27', the size of the openings 41 and the value of the frequency of vibration produced on the vibrating member are selected so that wavelength of the wave developed along the vibrating member is much larger than the diameter of the opening 41. Accordingly, the wave is developed on the vibrating member 27' as if the vibrating member were formed with no opening 41.

According to the present invention, furthermore, because the thickness of the vibrating member 27' is selected to be much larger than that of the particle controller 1, the particle controller 1 follows and is vibrated along with the vibration of the vibrating member 27' at all its parts except for the areas positioned at the openings 41.

Furthermore, according to the present invention, the material of the particle controller, the size of the openings 41 and the vibration frequency produced on the vibrating member (i.e., at the particle controller) are selected to develop, at area on the particle controller positioned at the opening 41, wave with wavelength larger than the width of the area represented by the diameter of the opening 41. Accordingly, no nonuniform wave such as nodes are produced on the particle controller at its area positioned at the opening 41.

Accordingly, the particle controller 1 can be effectively and stably vibrated. In other words, the particle controller, at its areas except for the areas positioned at the openings 41, is completely vibrated with the progressive wave which is uniformly developed in the vibrating member 27' as if the vibrating member were formed with no opening 41. The particle controller, at its areas positioned at the openings 41, is vibrated uniformly with no nodes being formed.

In this example, the power source E supplies a negative voltage to the back electrode roller 11'. This negative voltage forms an electric field between the particle controller 1 and the back electrode roller 11' for electrostatically attracting the toner particles T that have passed through the apertures 124 of the particle controller 1 toward the back electrode roller 11'. The toner particles T impinge and rest upon the image recording medium P as the image recording medium P passes between the particle controller 1 and the back electrode roller 11'.

Afterwards the image recording medium P is transported from the image recording portion 101 to the thermal fixing portion 102 where the image on the image recording medium P is thermally fixed. By means of the second guide 133', the image recording medium P passed through the thermal fixing portion 102 is transported to the sheet outlet 104, through which the image recording medium P is discharged out of the image forming apparatus.

According to the second embodiment, as described above, the shapes and sizes of the openings 41 can be disregarded in regards to the vibration generated along the vibrating member 27'. Accordingly, vibration is generated along the particle controller 1 as if the particle controller 1 were not formed with such areas as those positioned on the openings 41 of the vibrating member. Thus, the particle controller can completely follow the vibration occurred in the vibrating member 27' and therefore can be vibrated completely along with the vibrating member. In addition, since the width (diameter) of the opening is smaller than the wavelength of the wave generated on the particle controller at such areas as those positioned at the openings of the vibrating member, no vibration nodes are formed at the areas positioned on the openings, i.e., at portions around the apertures 124 which are positioned inside of the openings 41.

To summarize, since the opening 41 formed on the vibrating member 27' has such a shape and size as do not affect the vibration generated along the particle controller 1, the opening 41 will not disturb the vibration generated on the particle controller.

According to the present embodiment, the vibrating member 27' of the present embodiment may be variously modified.

Figure 7:
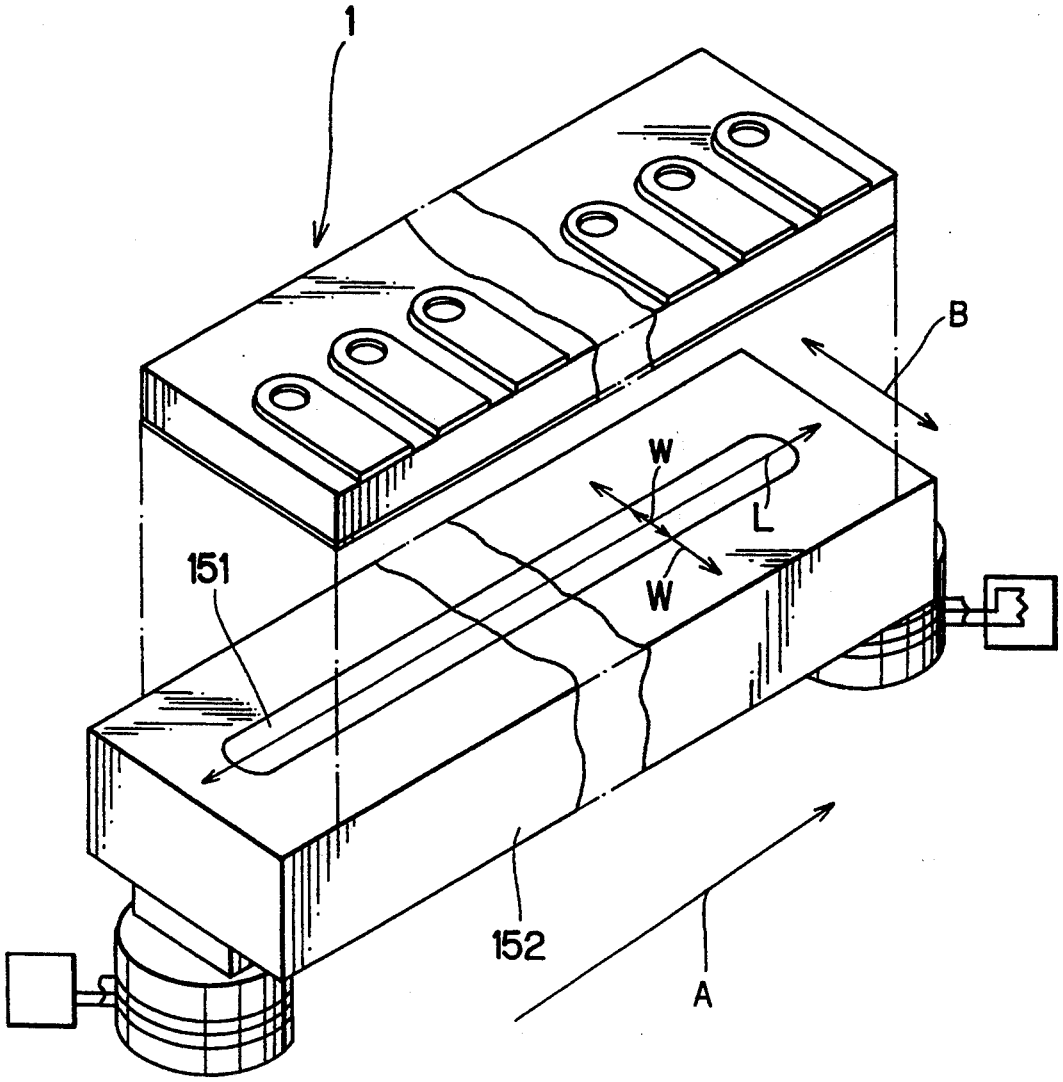
FIG. 7 is a perspective diagram of a variation of the vibrating member of the second embodiment.

FIG. 7 shows one modification of the vibrating member of the present embodiment. As shown in the drawing, the vibrating member 152 of the modification is formed with a slit-shaped opening 151. This slit-shaped opening 151 is especially well suited for a particle controller 1 with a small aperture pitch for achieving a high resolution. The slit-shaped opening 151 extends in the longitudinal direction L and has a width w in its widthwise direction W extending perpendicularly to the longitudinal direction L, as shown in the drawing. According to the present embodiment, the width w is sufficiently small in comparison with the wavelength of the waves generated along the vibrating member 152 and small in comparison with the wavelength of the waves generated in the particle controller 1. The width w may be selected to be 1 mm for the example described above for the example of the present embodiment. According to the present embodiment, the width w of the slit-shaped opening 151, which is sufficiently small in comparison with the wavelength of the wave generated along the vibrating member 152, eliminates nonuniformity in the widthwise direction B in the vibration produced in the vibrating member 152. Furthermore, the vibrating member 152 allows propagation of uniform progressive waves along its lengthwise direction A. Accordingly, the vibrating member 152 and therefore the particle controller 1 attached to the vibrating member vibrate uniformly.

Figure 8:
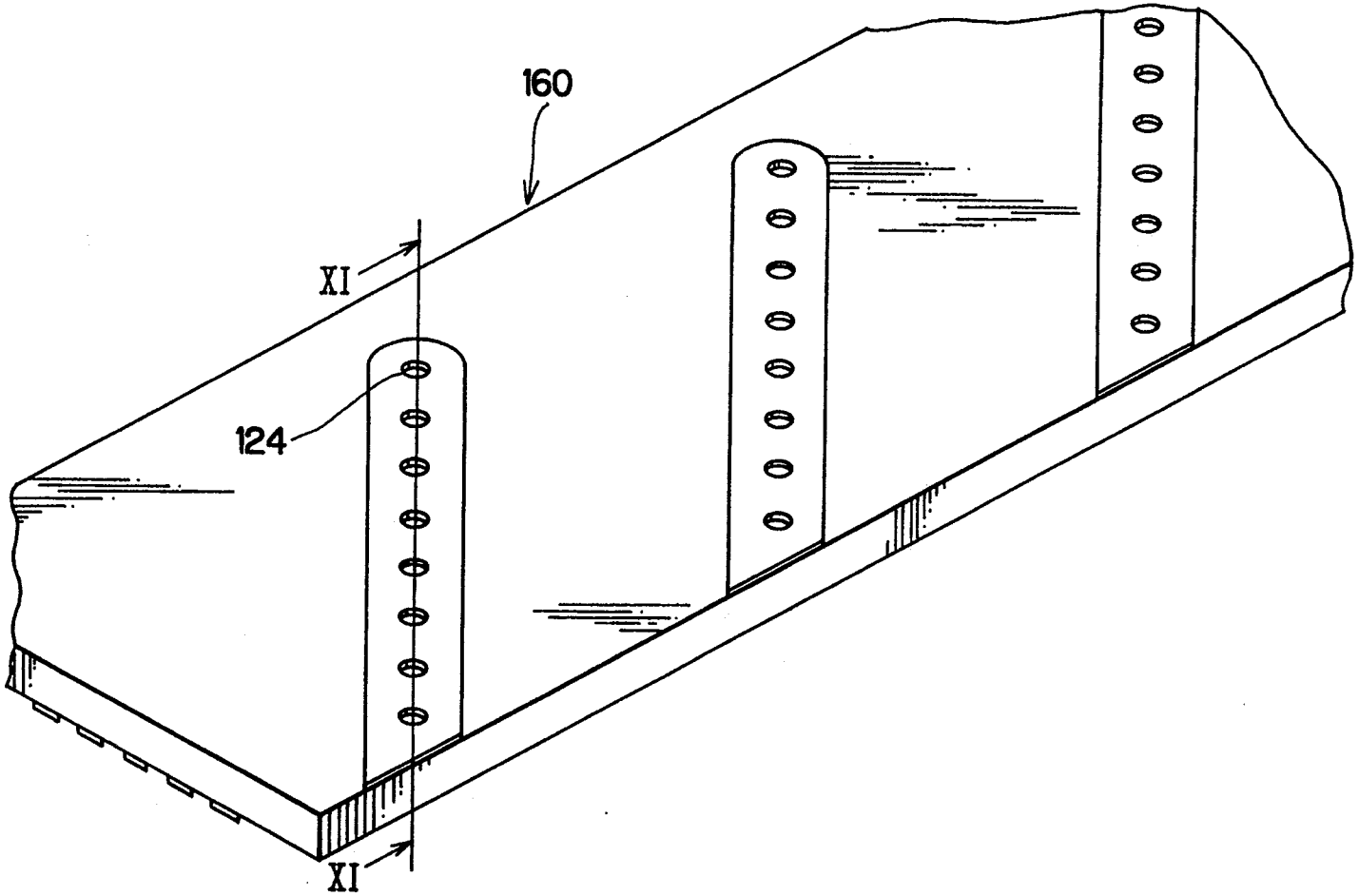
FIG. 8 is a perspective diagram of a variation of the particle controller of the second embodiment.

To attain a further high level of resolution, similarly as in the first embodiment, a matrix-type particle controller 160 as shown in FIG. 8 may be used. A vibrating member 162 shown in FIG. 9 may be combined with the matrix-type particle controller 160. Another vibrating member 164 shown in FIG. 10 may also be used with the matrix-type particle controller 160. The vibrating member 162 is formed with a plurality of slit-shaped openings 161 at positions that corresponds to the positions of the apertures 124 in the matrix-type particle controller 160. The vibrating member 164 is formed with a plurality of slit-shaped openings 163 at positions that corresponds to the positions of the apertures 124 in the matrix-type particle controller 160. The width w of each of the slit-shaped opening 161 and 163 along its widthwise direction W is selected to be sufficiently small in comparison with the wavelength of the vibration generated in the vibrating member and to be small in comparison with the wavelength of vibration generated in the particle controller 160.

Figure 9:
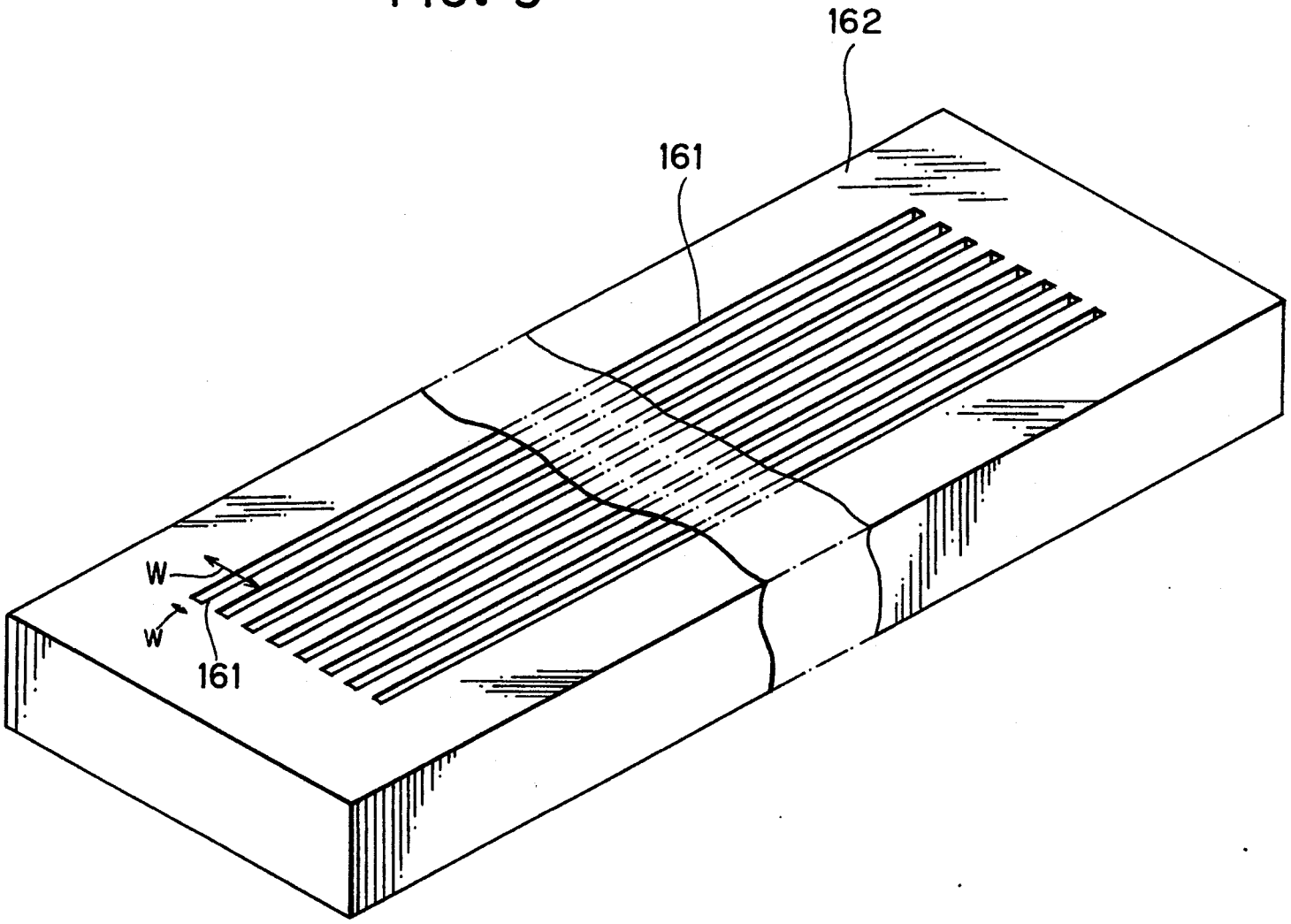
FIG. 9 is a perspective diagram of a variation of the vibrating member suited for the particle controller of FIG. 8.
Figure 10:
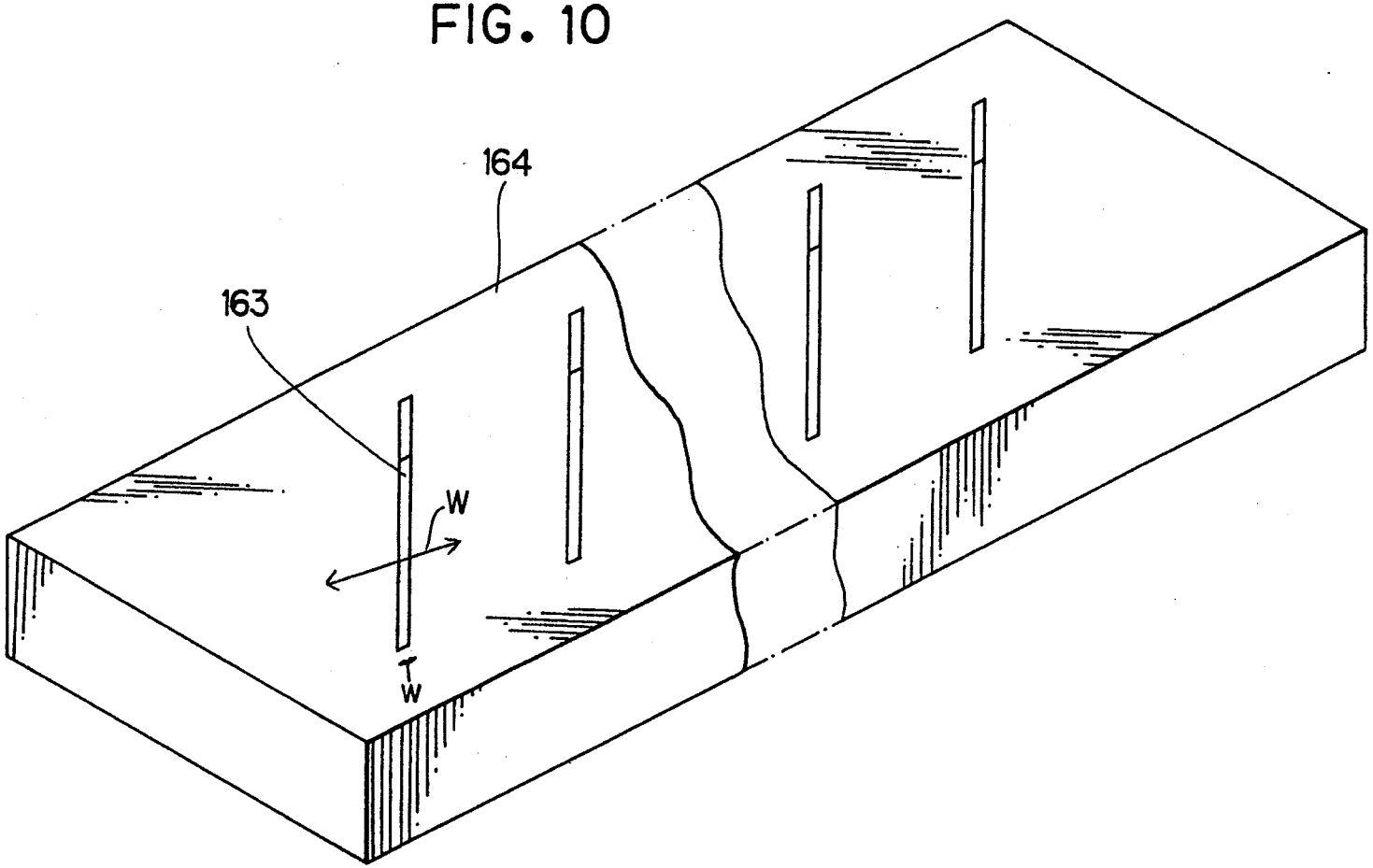
FIG. 10 is a perspective diagram of another variation of the vibrating member suited for the particle controller of FIG. 8.
Figure 11:
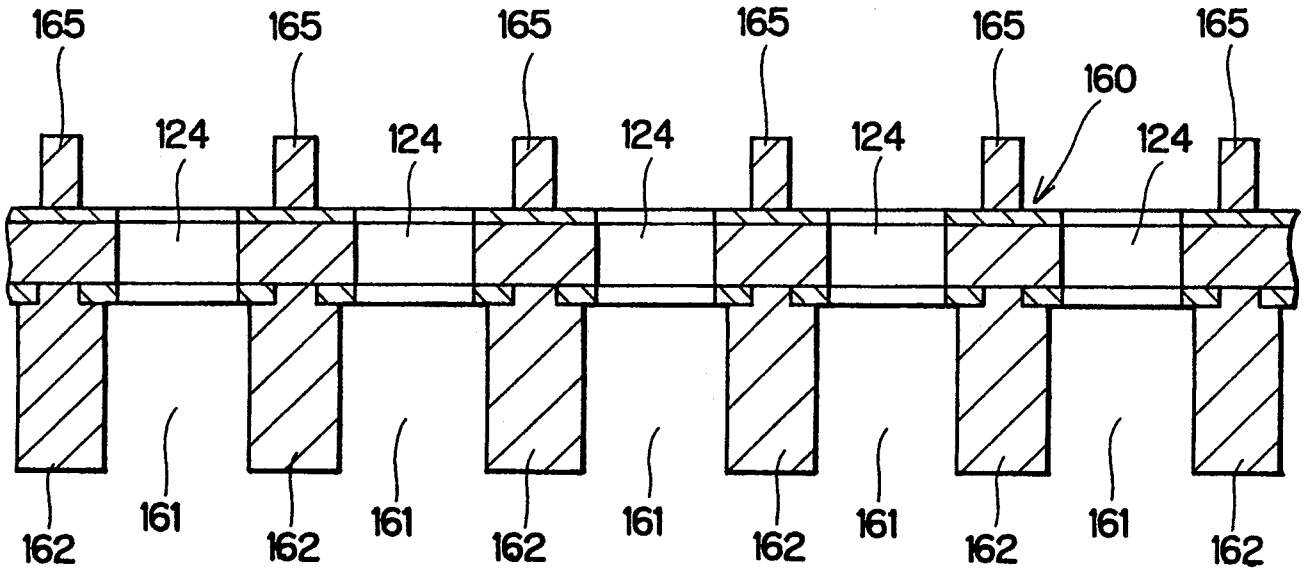
FIG. 11 is a cross-sectional side view of the particle controller attached with the vibrating member taken along the line XI—XI in FIG. 8.

To the combination of the matrix-type particle controller 160 of FIG. 8 and the vibrating member 162 of FIG. 9, anti-vibration members 165 formed of material such as silicon rubber can be attached, in the manner as shown in FIG. 11. The anti-vibration members 165 serve to isolate vibration occurring on adjacent rows of apertures 124 of the particle controller. Since isolating vibration in this way avoids interference of vibration from adjacent rows of apertures, more stable vibration of the particle controller can be obtained.

Figure 12:
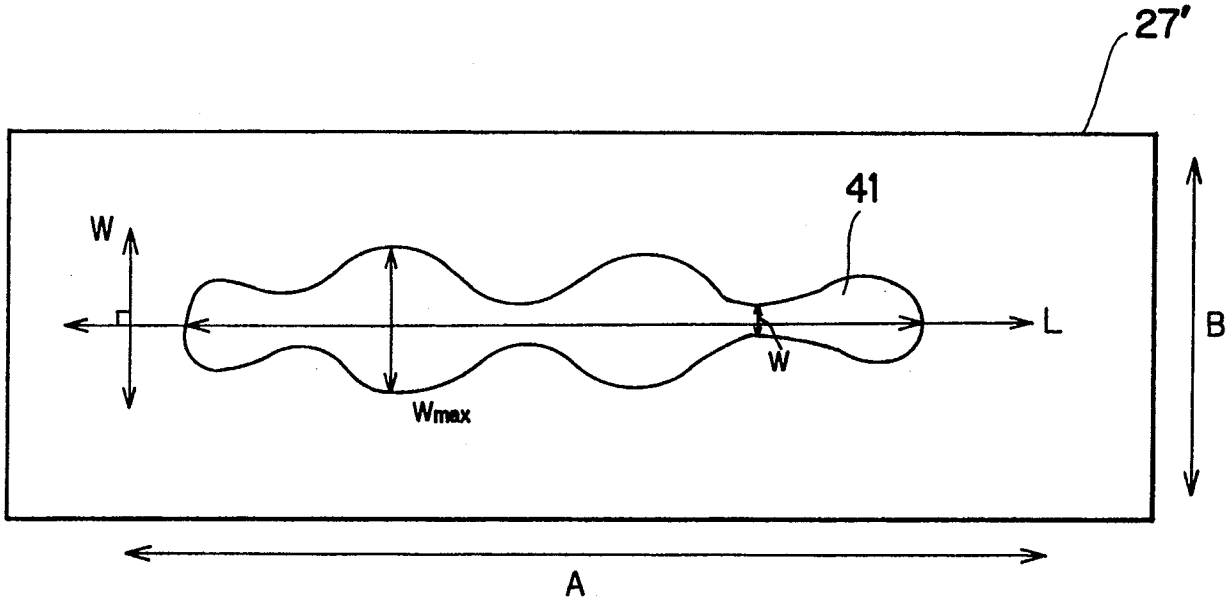
FIG. 12 illustrates a modification of the shape of the opening formed on the vibrating member.

According to the present embodiment, the shape of the opening 41 of the vibrating member can be freely selected. The shape may be circular or slit-shape, as shown in FIGS. 6 and 7. Furthermore, the opening 41 may be shaped as illustrated in FIG. 12 in which the maximum width $w_{max}$ along the widthwise direction W, which extends perpendicularly to the longitudinal direction L, is selected to a value that is sufficiently small in comparison with the wavelength of vibrations generated at the vibrating member and that is small in comparison with the wavelength of vibrations generated at the particle controller. It is noted that the opening 41 may be formed on the vibrating member 27' so that the longitudinal direction L of the opening is not parallel to the lengthwise direction A of the vibrating member along which the progressive wave is propagated. An angle formed between the longitudinal direction L of the opening 41 and the lengthwise direction A of the vibrating member along which the progressive wave is propagated may be freely selected.

In the above description, the vibrating member is combined with the exciting element and the vibration absorber at both ends in its lengthwise direction A so that the progressive wave is propagated along the lengthwise direction A. However, as shown in FIG. 2(*a*) in the first embodiment, the vibrating member may be combined with the pair of exciting elements at both sides in its widthwise direction B so that a standing wave is oscillated along the widthwise direction B. (Or otherwise, the vibrating member may be combined with the pair of exciting elements at both ends in its lengthwise direction A so that a standing wave is oscillated along the lengthwise direction A. ) Also in this case, the width w should preferably be selected to such a value that is sufficiently small in comparison with the wavelength of the vibration (standing wave) produced in the vibrating member and that is small in comparison with the wavelength of the vibration generated in the particle controller.

As described above, in the present embodiment, the maximum width $w_{max}$ in the widthwise direction W of the opening formed in the vibrating member is selected to have a value shorter than the wavelength of the vibration generated in the vibrating member. Accordingly, the particle controller can be effectively excited to be stably vibrated, and therefore the toner particles attached to the interior surface of the aperture of the particle controller can be completely shaken off.

Furthermore, the maximum width $w_{max}$ in the widthwise direction W of the opening of the vibrating member is selected to have a value shorter than the wavelength of the vibration generated in the particle controller. Accordingly, nodes will not be formed in the area around the aperture of the particle controller positioned in the interior of the opening of the vibrating member.

While the present invention has been described in detail and with reference to the specific embodiments thereof, it will be apparent to one skilled in the art that various changes and modifications can be made therein without departing from the spirit and scope thereof.

What is claimed is:

1. An image recording apparatus for recording an image on an image recording medium, comprising:

supply means for supplying electrically charged particles;

a particle controller having at least one aperture, said particle controller receiving the electrically charged particles from said supply means and selectively allowing the electrically charged particles to pass through the at least one aperture in accordance with image data supplied to the particle controller;

a back electrode positioned to confront said supply means through said particle controller, said back electrode being spaced from said particle controller by a space enabling passage of an image recording medium, said back electrode electrostatically attracting the electrically charged particles having passed through the at least one aperture of said particle controller in a direction toward said back electrode so that the electrically charged particles may be attached to the image recording medium positioned in the space to thereby form an image of the electrically charged particles on the image recording medium; and vibration applying means for vibrating said particle controller with a vibration acceleration having a value equal to or larger than 500 G, wherein G is gravitational acceleration, wherein said vibration applying means vibrates said particle controller, at least at an area around the at least one aperture, with a vibration amplitude having a value smaller than half a thickness of said particle controller.

2. The image recording apparatus as claimed in claim 1, wherein said vibration applying means includes:

a vibrating member attached to said particle controller on a side of the particle controller confronting at least one of said supply means and said back electrode, the vibrating member having at least one opening for exposing the at least one aperture of said particle controller to the at least one of said supply means and said back electrode, the at least one opening having a width; and an oscillating member for producing in the vibrating member a first vibration wave having a first wavelength, the vibrating member allowing a first part of said particle controller contacted with the vibrating member to follow the first vibration produced in the vibrating member, the first wavelength having a value larger than the width of the at least one opening of the vibrating member.

3. The image recording apparatus as claimed in claim 2, wherein the vibrating member of said vibration applying means produces a second vibration wave having a second wavelength in a second part of said particle controller positioned corresponding to the at least one opening of the vibrating member, the second wavelength having a value larger than the width of the at least one opening of the vibrating member.

4. An image recording apparatus for recording an image on an image recording medium, comprising:

supply means for supplying electrically charged particles;

a particle controller having at least one aperture, said particle controller receiving the electrically charged particles from said supply means and selectively allowing the electrically charged particles to pass through the at least one aperture in accordance with image data supplied to the particle controller;

a back electrode positioned to confront said supply means through said particle controller, said back electrode being spaced from said particle controller by a space enabling passage of an image recording medium, said back electrode electrostatically attracting the electrically charged particles having passed through the at least one aperture of said particle controller in a direction toward said back electrode so that the electrically charged particles may be attached to the image recording medium positioned in the space to thereby form an image of the electrically charged particles on the image recording medium;

a vibrating member attached to said particle controller on a side of the particle controller confronting at least one of said supply means and said back electrode, said vibrating member having at least one opening for exposing the at least one aperture of said particle controller to the at least one of said supply means and said back electrode, the at least one opening having a width; and an oscillating member for producing in said vibrating member a first vibration wave having a first wavelength, the first wavelength having a value larger than the width of the at least one opening of said vibrating member;

wherein said vibrating member allows a first part of said particle controller contacted with said vibrating member to vibrate along with said vibrating member with the first vibration; and wherein said vibrating member allows a second part of said particle controller positioned corresponding to the at least one opening of said vibrating member to vibrate with a second vibration wave having a second wavelength, the second wavelength having a value larger than the width of the at least one opening of said vibrating member.

5. The image recording apparatus as claimed in claim 4, wherein said oscillating member produces an oscillation having a frequency to produce in said vibrating member the first vibration wave having the first wavelength, which depends on the frequency of the oscillation and said vibrating member, said vibrating member allowing the first part of said particle controller to vibrate along with the vibrating member with the first vibration wave, the vibrating member allowing the second part of said particle controller to vibrate with the second vibration wave having the second wavelength, which depends on the frequency of the oscillation and said particle controller.

6. The image recording apparatus as claimed in claim 5, wherein the at least one opening of said vibrating member has a circularly-shaped cross section, and wherein said oscillating member causes the oscillation to have a frequency allowing the first wavelength and the second wavelength to have values larger than the diameter of the at least one opening of said vibrating member.

7. The image recording apparatus as claimed in claim 5, wherein the at least one opening of said vibrating member has a slit shape and extends in a longitudinal direction of said vibrating member, wherein the width of the at least one opening is in a widthwise direction extending perpendicularly to the longitudinal direction, and wherein said oscillating member causes the oscillation to have a frequency allowing the first wavelength and the second wavelength to have values larger than the width of the at least one slit-shaped opening of the vibrating member.

8. The image recording apparatus as claimed in claim 5, wherein the at least one opening of said vibrating member has a longitudinal direction, wherein the width of the at least one opening is in a widthwise direction extending perpendicularly to the longitudinal direction, wherein the at least one opening has a maximum width in the widthwise direction, and wherein said oscillating member causes the oscillation to have a frequency allowing the first wavelength and the second wavelength to have values larger than the maximum width of the at least one opening of said vibrating member.

9. The image recording apparatus as claimed in claim 4, wherein said oscillating member produces an oscillation having an amplitude allowing said particle controller to vibrate with a vibration amplitude having a value smaller than half a thickness of said particle controller.

10. An image recording apparatus for recording an image on an image recording medium, comprising:

a particle controller having a first and a second side and having at least one aperture penetrating through said particle controller from the first side to the second side, said particle controller selectively allowing electrically charged particles to pass through the at least one aperture from the first side toward the second side in accordance with image data supplied to the particle controller;

a back electrode positioned to confront the second side of said particle controller with a space being formed between said back electrode and the second side of said particle controller for enabling passage of an image recording medium, said back electrode electrostatically attracting, in a direction toward said back electrode, the electrically charged particles having passed through the at least one aperture of said particle controller so that the electrically charged particles may be attached to the image recording medium positioned in the space to thereby form an image of the electrically charged particles on the image recording medium; and vibration applying means for vibrating said particle controller with a vibration acceleration of a value equal to or higher than 500 G, wherein G is gravitational acceleration;

wherein the at least one aperture is formed in said particle controller to extend in a direction from the first side to the second side, said particle controller having a thickness defined as a distance between the first side ad the second side along the aperture extending direction; and wherein said vibration applying means allows said particle controller to be shifted along the at least one aperture extending direction in an oscillating manner so that said particle controller may be vibrated, at least at an area around the at least one aperture of said particle controller, with a maximum shift amount having a value smaller than the thickness of said particle controller.

11. The image recording apparatus as claimed in claim 10, wherein said vibration applying means includes oscillating means for oscillating a vibration and transmitting the vibration to said particle controller, the vibration having a frequency and an amplitude which have values allowing said particle controller to be vibrated with the vibration acceleration equal to or higher than 500 G.

12. The image recording apparatus as claimed in claim 10, wherein said vibration applying means includes oscillating means for oscillating a vibration and transmitting the vibration to said particle controller, the vibration having an amplitude which has values allowing said particle controller to be vibrated with a vibration amplitude of a value smaller than a half the thickness of said particle controller, at least at an area around the at least one aperture of said particle controller.

13. The image recording apparatus as claimed in claim 10, wherein said vibration applying means includes a vibrating member attached to said particle controller and an oscillating member for oscillating a vibration in the vibrating member, the vibrating member allowing said particle controller to vibrate along with the vibrating member, and wherein the oscillating member oscillates so that the vibration has a frequency and amplitude allowing said particle controller to be vibrated with the vibration acceleration having a value equal to or higher than 500 G and with the vibration amplitude having a value smaller than a half the thickness of said particle controller, at least at an area around the at least one aperture of said particle controller.

14. The image recording apparatus as claimed in claim 13, wherein the oscillating member vibrates the vibrating member so as to produce, in the vibrating member, a standing wave which has an amplitude oscillation in a direction parallel to the aperture extending direction and which is propagated in a direction perpendicular to the aperture extending direction in the vibrating member.

15. The image recording apparatus as claimed in claim 10, wherein said vibration applying means includes:

a vibrating member attached to at least one of the first and the second side of said particle controller and having at least one opening which communicates with the at least one aperture of said particle controller and which has a width, said particle controller having a first part positioned corresponding to an area of the at least one of the first and the second side contacted with the vibrating member and a second part positioned corresponding to the at least one opening of the vibrating member; and an oscillating member for producing an oscillation having a frequency to produce in the vibrating member a first vibration wave having a first wavelength corresponding to the frequency of the oscillation, the vibrating member allowing said particle controller to vibrate, at the first part thereof, along with the vibrating member so that the first vibration wave having the first wavelength may be produced in said particle controller at the first part.

16. The image recording apparatus as claimed in claim 15, wherein the oscillating member of said vibration applying means causes the oscillation to have a frequency allowing the first wavelength to have a value larger than the width of the at least one opening of the vibrating member.

17. The image recording apparatus as claimed in claim 15, wherein the at least one opening of the vibrating member has a circularly-shaped cross section, and wherein the oscillating member of said vibration applying means causes the oscillation to have a frequency allowing the first wavelength to have a value larger than the diameter of the at least one circularly-shaped opening of the vibrating member.

18. The image recording apparatus as claimed in claim 15, wherein the at least one opening of the vibrating member has a slit shape which extends in a longitudinal direction of the vibrating member and has a width in a widthwise direction extending perpendicularly to the longitudinal direction, and wherein the oscillating member of said vibration applying means causes the oscillation to have a frequency allowing the first wavelength to have a value larger than the width of the at least one slit-shaped opening of the vibrating member.

19. The image recording apparatus as claimed in claim 15, wherein the at least one opening of the vibrating member has a longitudinal direction and a widthwise direction extending perpendicularly to the longitudinal direction and has a maximum width in the widthwise direction, and wherein the oscillating member of said vibration applying means causes the oscillation to have a frequency allowing the first wavelength to have a value larger than the maximum width of the at least one opening of the vibrating member.

20. The image recording apparatus as claimed in claim 15, wherein the vibrating member produces, in said particle controller at a second part thereof, a second vibration wave having a second wavelength which corresponds to the frequency of the oscillation.

21. The image recording apparatus as claimed in claim 20, wherein the oscillating member of said vibration applying means causes the oscillation to have a frequency allowing the second wavelength to have a value larger than the width of the at least one opening of the vibrating member.

22. The image recording apparatus as claimed in claim 20, wherein the at least one opening of the vibrating member has a circularly-shaped cross section, and wherein the oscillating member of said vibration applying means causes the oscillation to have a frequency allowing the second wavelength to have a value larger than the diameter of the at least one circularly-shaped opening of the vibrating member.

23. The image recording apparatus as claimed in claim 20, wherein the at least one opening of the vibrating member has a slit shape which extends in a longitudinal direction of the vibrating member and has a width in a widthwise direction of the vibrating member extending perpendicularly to the longitudinal direction, and wherein the oscillating member of said vibration applying means causes the oscillation to have a frequency allowing the second wavelength to have a value larger than the width of the at least one slit-shaped opening of the vibrating member.

24. The image recording apparatus as claimed in claim 20, wherein the at least one opening of the vibrating member has a longitudinal direction and a widthwise direction extending perpendicularly to the longitudinal direction and has a maximum width in the widthwise direction, and wherein the oscillating member of said vibration applying means causes the oscillation to have a frequency allowing the second wavelength to have a value larger than the maximum width of the at least one opening of the vibrating member.

25. The image recording apparatus as claimed in claim 15, wherein the oscillating member vibrates the vibrating member so as to produce, in the vibrating member, a progressive wave which has an amplitude oscillation in a direction parallel to an aperture extending direction along which the at least one aperture extends in said particle controller and which is propagated in a direction perpendicular to the aperture extending direction in the vibrating member.

26. The image recording apparatus as claimed in claim 10, further comprising supply means for supplying the electrically charged particles to the first side of said particle controller.

* * * * *